US010711604B2

(12) United States Patent
Johnson

(10) Patent No.: US 10,711,604 B2
(45) Date of Patent: Jul. 14, 2020

(54) HYDRAULIC FRACTURING

(71) Applicant: Shear Frac Group, LLC, Kemah, TX (US)

(72) Inventor: Wesley W Johnson, Spring, TX (US)

(73) Assignee: SHEAR FRAC GROUP, LLC, Spring, TX (US)

( * ) Notice: Subject to any disclaimer, the term of this patent is extended or adjusted under 35 U.S.C. 154(b) by 24 days.

(21) Appl. No.: 16/190,088

(22) Filed: Nov. 13, 2018

(65) Prior Publication Data

US 2019/0145251 A1 May 16, 2019

Related U.S. Application Data

(60) Provisional application No. 62/584,979, filed on Nov. 13, 2017.

(51) Int. Cl.

| | |
|---|---|
| ***E21B 49/00*** | (2006.01) |
| ***E21B 47/06*** | (2012.01) |
| ***E21B 43/267*** | (2006.01) |

(52) U.S. Cl.
CPC ..... *E21B 49/00* (2013.01); *E21B 43/267* (2013.01); *E21B 47/06* (2013.01)

(58) Field of Classification Search
CPC ..... E21B 49/00; E21B 43/267; E21B 47/06
See application file for complete search history.

(56) References Cited

U.S. PATENT DOCUMENTS

| | | | | |
|---|---|---|---|---|
| 5,377,104 | A * | 12/1994 | Sorrells | E21B 41/0057 702/11 |
| 8,412,500 | B2 | 4/2013 | Weng et al. | |
| 9,581,004 | B2 | 2/2017 | Ciezobka et al. | |
| 2011/0120712 | A1 | 5/2011 | Todd et al. | |
| 2012/0318500 | A1 | 12/2012 | Uthancic et al. | |
| 2014/0251626 | A1 | 9/2014 | Gomaa et al. | |
| 2015/0101808 | A1 | 4/2015 | Saini et al. | |
| 2016/0177706 | A1* | 6/2016 | Holland | E21B 49/006 702/11 |

FOREIGN PATENT DOCUMENTS

| | | |
|---|---|---|
| WO | WO2017/052529 | 3/2017 |
| WO | WO2017074304 | 5/2017 |
| WO | WO2017/100222 | 6/2017 |

OTHER PUBLICATIONS

Clarkson et al., "Innovative use of rate-transient analysis methods to obtain hydraulic-fracture properties for low-permeability reservoirs exhibiting multiphase flow", University of Calgary, The Leading Edge, vol. 33, dated Oct. 20I4, 8 pages.

(Continued)

*Primary Examiner* — Brad Harcourt
(74) *Attorney, Agent, or Firm* — Fish & Richardson P.C.

(57) ABSTRACT

A system and method of hydraulic fracturing a geological formation in Earth's crust, including injecting fracing fluid through a wellbore into the geological formation, measuring pressure associated with the hydraulic fracturing, determining net stress of the geological formation from the hydraulic fracturing, and determining presence of complex shear fracturing or complex shear fractures correlative with the net stress.

17 Claims, 11 Drawing Sheets

(56) References Cited

OTHER PUBLICATIONS

Kim et al., "Numerical analysis of fracture propagation during hydraulic fracturing operations in shale gas systems," International Journal of Rock Mechanics & Mining Sciences 76, 127-137, dated Feb. 16, 2015, 11 pages.
McClure, "Characterizing Hydraulic Fracturing with a Tendency for Shear Stimulation Test", University of Texas at Austin, Roland Horne, Stanford University. SPE 166332-MS, dated Oct. 2013, 17 pages.
Suarez-Rivera et al., "Optimizing Lateral Landing Depth for Improved Well Production", URTeC: 2460515, dated Aug. 1-3, 2016, 13 pages.
Warren et al., "The Behavior of Naturally Fractured Reservoirs", Society of Petroleum Engineers, 245-55. Trans. AIME, 228, dated Sep. 1963, 9 pages.

* cited by examiner

HYDRAULIC FRACTURING

CROSS-REFERENCE TO RELATED APPLICATION

This application claims the benefit of priority to U.S. Provisional Application Ser. No. 62/584,979 filed on Nov. 13, 2017, the contents of which are hereby incorporated by reference.

TECHNICAL FIELD

This disclosure relates to hydraulic-fracturing analysis and control.

BACKGROUND

Hydraulic fracturing is generally applied after a borehole is drilled and a cased wellbore formed. Hydraulic fracturing employs fluid and material to create or restore fractures in a geological formation in order to stimulate production from new and existing oil and gas wells. The fracturing typically creates paths that increase the rate at which production fluids can be produced from the reservoir formations. In some instances, water and sand make up 98 to 99.5 percent of the fluid used in hydraulic fracturing. In addition, chemical additives may be incorporated in the water. The formulation varies depending on the well. Moreover, operating wells may be subjected to hydraulic fracturing to remain operating. Fracturing may allow for extended production in older oil and natural gas fields. Hydraulic fracturing may also allow for the recovery of oil and natural gas from formations that geologists once believed were impossible to produce, such as tight shale formations.

Hydraulic fracturing in development of an oil-and-gas well may involve injecting water, sand, and chemicals under high pressure through a wellbore into a geological formation in the Earth's crust. This process may create new fractures in the rock as well as increase the size, extent, and connectivity of existing fractures and bedding planes. Thus, hydraulic fracturing (also called fracing or fracking) is a well-stimulation technique in which rock is fractured by a pressurized liquid. The process can involve the high-pressure injection of fracing fluid (also labeled fracking fluid, frac fluid, etc.) into a wellbore to generate cracks in the deep-rock formations through which natural gas, petroleum, and brine will flow more freely. An example of fracing fluid is primarily water containing sand or other proppants. In some instances, the sand or other proppants may be suspended in the water with the aid of viscosity increasing agents. Other chemical additives may be added to the fracing fluid to reduce friction, such as in slick water. Fracing jobs may direct completion hardware, sand weights, and water volumes to place sand.

In sum, hydraulic fracturing is used in the oil and gas industry to increase the flow of oil and/or gas from a well. The producing formation is fractured open using hydraulic pressure and then proppants (propping agents) may be pumped into the oil well with fracturing fluid to hold the fractures or fissures open so that energy (pressure) can be applied (e.g., pumped fracing fluid) into the formation and converted to stress, to enhance the breaking of the rock. The result is the natural gas or crude oil can flow more easily up the well. Hydraulic fracturing is employed in low-permeability rocks such as tight sandstone, shale, and some coal beds to increase crude oil or gas flow to a well from petroleum-bearing rock formations. Hydraulic fracturing can be applied for vertical or deviated (e.g., horizontal) wellbores. A beneficial application may be horizontal wellbores in low-permeability geological formations having hydrocarbons such as natural gas, crude oil, etc. Massive hydraulic fracturing or high-volume hydraulic fracturing may be applied to gas or oil-saturated formations with low permeability (e.g., less than 0.1 millidarcy).

SUMMARY

An aspect relates to a method of hydraulic fracturing a geological formation in the Earth crust, including injecting fracing fluid through a wellbore into the geological formation, measuring pressure associated with the hydraulic fracturing, determining net stress of the geological formation associated with the hydraulic fracturing, and determining presence of complex shear fracturing (e.g.,) correlative with the net stress. The net stress of the geological formation be at or caused by the hydraulic fracturing. The net stress may be fracture tip stress or fracture-tip net stress, etc. including at a particular or specified time or times. The complex shear fracturing may be high surface-area shear fracturing, etc. The method may be or include a computer-implemented method.

Another aspect relates to a hydraulic fracturing system including a pump to inject fracing fluid through a wellbore into a geological formation for hydraulic fracturing of the geological formation. In some cases, the system includes one or more blenders to vary proppants and fluid viscosities. The system includes a pressure sensor at the wellhead or downhole to measure pressure associated with the hydraulic fracturing. Further, the fracturing system includes a computing system to determine net stress of the geological formation at specified times associated with the hydraulic fracturing and to determine presence of complex shear fractures caused by the hydraulic fracturing and correlative with the net stress. Complex shear fractures generally collectively have high surface area relative to a planar tensile fracture system.

Yet another aspect relates to a non-transitory, computer-readable medium having instructions executable by a processor of a computing device to receive measured pressure data associated with hydraulic fracturing of a geological formation in the Earth crust, determine net stress of the geological formation due to hydraulic fracturing, and determine presence of complex shear fracturing correlative with the net stress.

The details of one or more implementations are set forth in the accompanying drawings and the description below. Other features and advantages will be apparent from the description and drawings, and from the claims.

DETAILED DESCRIPTION

Figure 1:
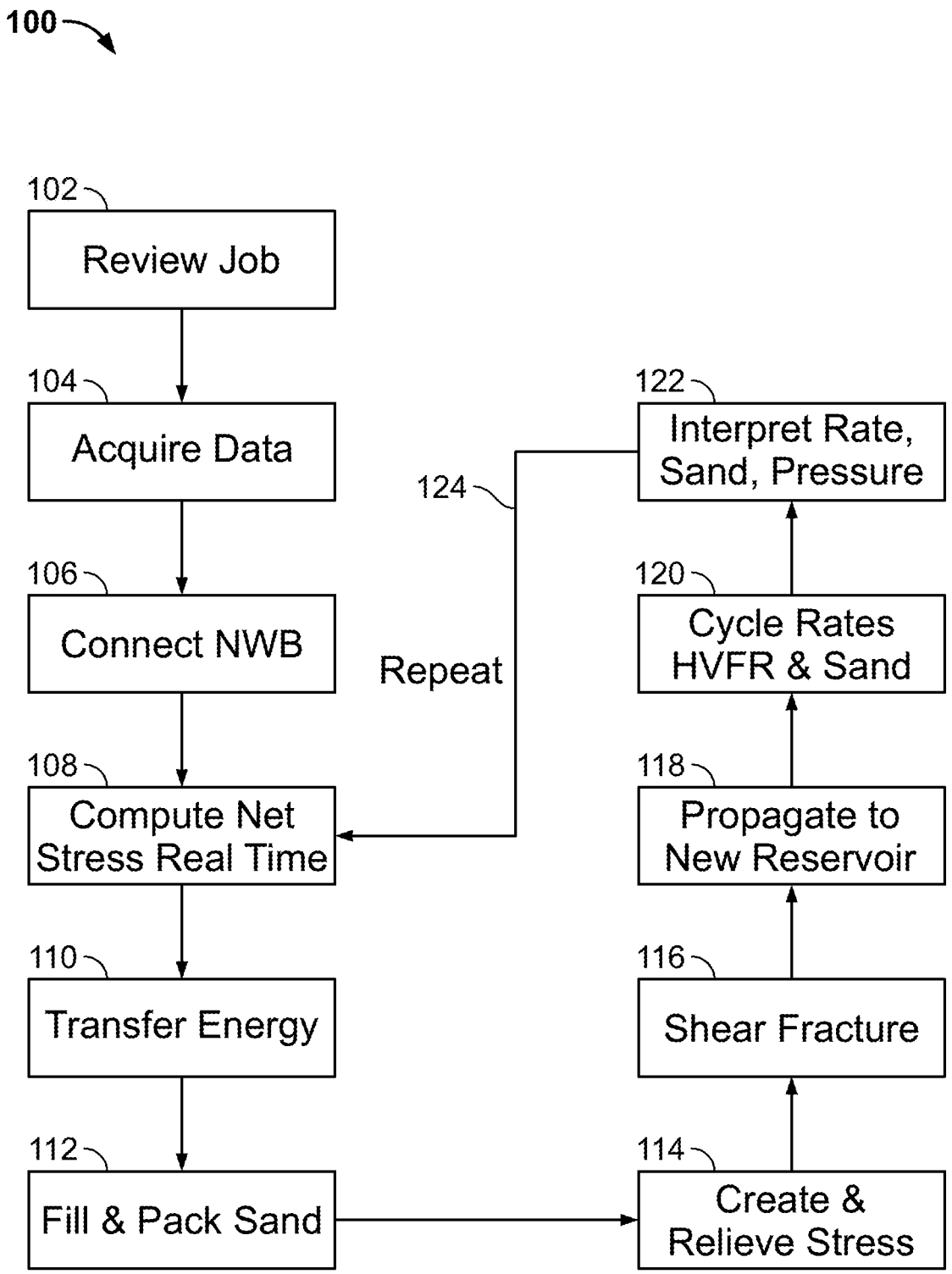
FIG. 1 is block flow diagram of a method of analyzing and controlling hydraulic fracturing including to control fracture stress.

Embodiments of the present techniques relate to a system and method of hydraulic fracturing a geological formation in the Earth crust, including injecting fracing fluid through a wellbore into the geological formation, measuring pressure associated with the hydraulic fracturing, determining net stress of the fracturing or fractures (e.g., at specific times) in the geological formation at or caused by the hydraulic fracturing, and determining presence of complex shear fracturing or complex shear fractures (e.g., collectively having high surface area) correlative with the net stress. The complex shear fracturing may generally be high surface-area shear fracturing. The net stress may be fracture tip net stress. The net stress may be net stress (fracture tip stress) at a particular or given time, or time period. Indeed, the net stress may be a calculated value of net stress at a specific time or time period. Another aspect relates to computer-facilitated or computer-guided implementation of real-time shear fracturing including net stress analyses with neural networks, machine learning, artificial intelligence, or computer code with equations, or any combinations thereof, to compute net stress, or stress patterns that are additive to net stress during complex shear fracturing, and so on.

Yet another aspect relates to a hydraulic fracturing system including a pump(s) to inject fracing fluids and a blender(s) to vary proppants and fluid viscosities with pump rates through a wellbore into a geological formation for hydraulic fracturing of the geological formation. The system includes a pressure sensor to measure pressure associated with the hydraulic fracturing. The pressure sensor or pressure gauge may be at the wellhead of the wellbore or lowered downhole into the wellbore, or be two pressure sensors with a pressure sensor disposed at each location, respectively. Again, the pressure sensors may include pressure gauges.

Further, this embodiment of a fracturing system includes a computing system to determine net stress of the geological formation at specified times associated with the hydraulic fracturing and to determine presence of complex shear fractures caused by the hydraulic fracturing and correlative with the net stress. Complex shear fractures may be small shear fractures that collectively give high surface area including greater surface area than a single planar fracture. Thus, again, complex shear fracturing may be characterized as high surface-area shear fracturing. A planar fracture may be labeled as a tensile fracture or a planar tensile fracture, and the like. Complex shear fracturing may give a large number of shear fractures or fracture branches (e.g., in a localized volume) and in which the shear fractures can be very small. While the shear fractures may be referred to as complex shear fractures due to their formation via complex shear fracturing, the shear fractures may be simple shear fractures. Moreover, while complex shear fracturing may be referred to as giving high surface area, an individual or single shear fracture or branch may have less surface area than a single planar tensile fracture. However, a shear fracture may be characterized as dendritic and with many branches. Whether such a fracture formation is viewed as a shear fracture or shear fractures, such a branching shear fracture or shear fracture event may originate with a stress event such as the relieving of accumulated stress. Hydraulic fracturing produces both tensile and shear fractures—both may be measured and counted to determine fracture efficiency. Indeed, hydraulic fracturing can include both shear fracturing and tensile fracturing. The presence of shear fracturing can be determined. The presence of tensile fracturing can be determined.

Embodiments of the present techniques involve analysis and control of hydraulic fracturing (fracing, fracking, frac, etc.). Some implementations may count the type and number of fractures and the volume of sand contained therein to specify SRV Particular implementations interpret pressure readings or pressure signals to control fracing injection rates (frac rates), fluid thickness or viscosity, stress pulses (additive or subtractive) or sand concentrations, or any combinations thereof, to cause complex shear fracturing. Complex shear fracturing may also be labeled as shear fracturing, complex fracturing, high surface-area fracturing, high surface-area shear fracturing, high surface-area complex fracturing, etc. The pressure readings may be pressure signals from a sensor or instrument measuring pressure at a wellhead or downhole (e.g., bottom hole) in the wellbore, including when complex shear fractures are being formed via hydraulic fracturing. As discussed below, implementations may be modified or adjusted in real time. Certain embodiments employ expert and/or neural networks for pattern recognition to control hydraulic fracturing including adjusting operation of the hydraulic fracturing system and equipment. The technique may utilize neural networks or other computer code instructions to compute stress and predict the pressure and injection rates at which each fracturing stage should be treated to increase or maximize complex shear fracturing including as rocks change. The rocks changing may be due to the effects of the hydraulic fracturing or existing variation in rock morphology or rock type, and so on.

The term "rock" or "rocks" may be defined generally as solid portions of the geological formation that are not liquid or gas. The rock can include shale and other rock types. The complex shear fracturing of rock may be facilitated where the rock is laminated. The geological formation includes the rock, as well as any liquid and gas. A geological formation may also be labeled as a formation, hydrocarbon formation, reservoir formation, reservoir, and so on.

When shale reservoirs are hydraulically fractured with injected fluid, the contacted rock volume and measured pressure generally change through time. Patterns in treatment pressure and stress may be evaluated to measure and control fracturing in real-time. Embodiments may account for rock laminations, natural fractures, near wellbore (NWB) applications, completion efficiency, fracture complexity, fracture dilation, energy transfer, and sand filling, and so on. Stress build-up and stress relief may trigger shear fracturing including massive shear fracturing. In terms of analysis, an analogy may be interpreting human speech as waves of pressure or sound with subtle patterns that convey information. Pressure or stress patterns can also be interpreted to reveal complex shear fractures or planar tensile fractures and changes in rocks. Pressure or stress patterns may originate from complex fracturing and complex fractures. In some cases, pressure measured from planar (tensile) fracture systems generally have few or no pressure patterns that are readily descriptive of fractures or reservoirs.

In some implementations, frac rates are adjusted to increase or optimize hydraulic shear fracturing in each stage. The adjustments may be in in real time or every few minutes, or in response to analysis. The frac rates may be the flow rates, a property (e.g., viscosity, density, thickness, etc.) of the fracing fluid or fracing slurry, the concentration of proppant (e.g., sand) in the fracing fluid, applied or treating pressure, and so forth. The adjustment of frac rates may also include pulsing the flow or pressure to give stress pulses at the fractures. The frac rates may include a clean rate which is flow rate of fracing fluid without proppant, a slurry rate which may be a flow rate of a slurry of the fracing fluid (e.g., a thicker or more viscous fracing fluid) and proppant, and the like. In particular implementations, the frac rates or parameters adjusted may include at least two variables which are fracing-fluid pump(s) rate and proppant (e.g., sand) concentration in the fracing fluid. Frac operations can be manual, guided with controllers and software, and so on. Certain examples of the present techniques have been trademarked as Shear FRAC™. Certain embodiments decode pressure or stress data to describe fracturing processes and adjust hydraulic field systems and processes in response in real time. The techniques may adjust hydraulic fracturing in real time to increase fracture surface area from the available rocks in fracturing stages of wells. Lastly, while Shear FRAC™ is mentioned, the present techniques are not limited to any trademarked process or technique.

An objective may be to generate shear fractures with relatively high surface area so that oil and gas in shales or similar formations can flow with increased rates and recoveries to producing wells. As indicated, examples apply neural networks or innovative equations embedded as executed code to analyze treating pressure or stress patterns (including in real-time) to describe and control fracture network growth. Certain implementations interpret the rock properties of the rock volumes being hydraulically fractured. In some examples, rock may be a significant control on fracture growth. Rock volumes can be near wellbore (e.g., less than 10 feet from wellbore), mid-field (e.g., 10 feet to 100 feet from wellbore), far field (e.g., >100 feet from wellbore), and so on. Other characterizations of rock volumes are applicable.

Embodiments evaluate hydraulic fracturing via pressure patterns (and stress patterns), the evaluation which may include near-wellbore (NWB) tensile fracturing, slick water lamination and fracture dilation with slip, sand transfer and sand packing, stress buildup and stress relief, and tensile and shear fracturing (e.g., tensile with dominantly shear fracturing in mid and far field regions). The techniques may measure pressures and derivatives of pressure from complex fracture systems. Some implementations employ fine proppants (e.g., in the ranges of 40/70 mesh to 200 mesh, 40/70 mesh to 100 mesh, or at least 100 mesh, etc.) to convert energy from slick water to rock stress, which can generate high surface-area rock destruction. In all, examples may save water and sand by discontinuing water and sand injection when there is no longer adequate energy to significantly propagate shear fractures. Embodiments provide real-time control of fractures that create increased or maximum fracture surface area and well productivity, with more efficient use of injected water and sand in some examples. Hydrocarbon recovery may be increased, well spacing improved or optimized, and field developments focused in the desired pay zones, and so forth.

The technique may compute net stress at fracture tips and correct for pressure changes due to friction losses in wells, perforations, and rocks between the wells and fracture tips. Indeed, the net stress may be fracture tip stress and related to fracture tip pressure. The fracture tip may be the interface between the advancing fracing fluid and the rock. Factors such as net pressure, in-situ stress, and so forth, may be considered. The technique may recognize when complex shear fracturing is occurring such as by recognizing pressure and stress patterns of fracture dilation and fracture slip, followed by observing net stress build-up and rock shear failure in the geological formation being fractured. Real-time adjustments can be made to injection fracing-fluid rates, fracing fluid viscosity, and sand concentrations, and the like, in response to counting shear and tensile fractures. Increasing shear fractures in each well stage can increase production potential for each stage. Optimal or beneficial amounts of fracing fluid and proppant (e.g., sand) may be measured for each fracturing stage. Complex shear fracturing may be initiated early by introducing and placing proppant earlier than typical. Proppant and fracing fluid (e.g., including water) may be discontinued when complex shear fracturing dissipates for lack of sufficient energy (pressure) and stress (e.g., including associated sand packing).

In some cases, tensile fracturing may be the tearing of rock and generally not significantly constrained by rock fabric. Tensile fracturing may be constrained by rock matrix if pump rates are controlled slowly enough to allow frac fluid to enter weaknesses in the rock. Complex shear fracturing in some cases is easier to constrain by rock laminations and thus by rock fabric. Rock properties or changes may impact control of the hydraulic fracturing for complex shear fractures. For hydraulic fracturing, geomechanics may be considered. Young's modulus, which is a mechanical property that measures the stiffness of a solid material, may be evaluated. Young's modulus may be an indication of rock strength. Poisson's ratio may also be considered. Poisson's ratio may be an indication of distortion of the rock before breaking during fracturing. Moreover, fracing fluid of low viscosity or high viscosity may be employed in the hydraulic fracturing. Proppant such as sand of small particle size or large particle size may be utilized.

Well spacing may be optimized or improved in fractured rock volumes. Shear fractures may create complex connections into pores containing hydrocarbons. Conversely, tensile fractures on average may be farther apart and are not ideal for tuning well spacing and fluid recovery. In contrast, fractures may be more contained in pay when initiated as shear fractures in laminated shale rocks. Pressure and stress patterns or waves focused in pay may break rocks more thoroughly. Pay may generally be a portion or region (of a geological formation) having adequate organic or hydrocarbon content such that the recovery of hydrocarbon may give a beneficial economic return. Pay may also be a localized description as a portion of the formation sharing laminations and the same hydrocarbon deposits, and in which the rock can fracture and be filled with sand.

Fine sand (e.g., 100 mesh or smaller) may be better transported than sand of larger particle size in that the small fractures (e.g., 100 mesh or smaller) collectively of complex shear fracturing can provide significant cross-sectional area and fracture volume to receive the fine sand. In fluid dynamics, Bernoulli's principle states that an increase in the speed of a fluid flowing has the potential to increase the pressure drop on the downstream side of particles 606 in FIG. 6. Such flow may give more efficient transport of fine sand and can increase concentration of stress including because fractures are closer together.

Unlike prior techniques, embodiments herein measure wellhead pressure or downhole pressure to measure or determine fracture tip pressure or fracture tip stress, and to recognize pressure and stress patterns indicating complex shear fracturing. Some examples can generally specify how much sand per unit length (e.g., foot) should be placed in each well, and with water pumped in sufficient volumes to place the sand, and so forth. Unlike previous techniques, certain embodiments herein adjust fluid rates and sand concentrations to favor creation of shear fractures over tensile fractures, and thus to maximize or increase fracture surface area and production potential for each fracturing stage. A fracturing stage may include clusters of perforations to induce fractures.

Prior solutions for hydraulic fracturing have employed excessive or maximum energy input (via frac flow rate, frac pressure, frac time, etc.) to generate increased or maximum number of fractures, which can be measured with micro seismic data. The type of fractures can be interpreted from micro seismic moment tensor inversion (MTI). MTI generally cannot be performed in real-time or used to adjust injection rates or sand concentration because they are post-frac evaluations. Conversely, optimization of sand and water in real-time to adjust to changing rock volumes can be performed by creating and counting complex shear fractures, as discussed herein. Well spacing by prior techniques placed wells at different spacing, perhaps 250, 500, 750, or 1000 feet apart to observe production differences with fracture systems that tended to be planar. Fractures propagated at crack velocities may exceed the speed of sound without the ability to be contained in height, half wing length or width. There have previously been poor correlations between productivity and well spacing. In contrast, with complex shear fractures and example implementations herein, the fractured and propped rock volumes are generated by design and well spacing can be matched to fracture volumes. The amount of sand contained in shear fractures can be calculated to represent stimulated reservoir volume (SRV). Certain implementations improve the measurement of stimulated reservoir volume (SRV) by counting shear fractures and computing the sand volume therein contained.

Moreover, prior practices generally have little control over height growth. Some fracture modeling software used to design fractures is based on matrix strength (Young's modulus) and matrix elasticity (Poisson's ratio). The presence of laminations in the rock may provide for greater control over fracturing. Historical fracture modeling software may not represent the full complexity of fracture growth in laminated rocks. Complex shear fractures placed in laminated sequences may provide better pay containment and more efficient fracturing and production. Furthermore, sand transport has been explained historically by Navier-Stokes equations modeling for wide vertical fractures. The incompressible Navier-Stokes equations with conservative external field may be fundamental equations of hydraulics. Models based on such equations typically cannot explain how small fractures become sand full. By contrast, embodiments herein may explain how Bernoulli's principle is relied upon to fill and stress small fractures with fine sand. These physics explain benefits of fine sand for converting pressure to stress and fracture surface area.

The technique may compute net stress at fracture tips (e.g., at specified times) to correct for pressure changes due to friction losses in wells, perforations, and rocks between the wells and fracture tips. The technique may recognize when shear fracturing is occurring such as by recognizing pressure and stress patterns of fracture dilation and fracture slip, followed by observing net stress build-up and rock shear failure in the geological formation being fractured. Real-time adjustments can be made to injection fracing-fluid rates and sand concentrations in response to counting shear and tensile fractures. Increasing shear fractures in each well stage can increase production potential for each stage. Optimal or beneficial amounts of water and sand may be measured for each fracturing stage. Shear fracturing may be initiated early by introducing and placing sand earlier than typical. Sand and water may be discontinued when shear fracturing dissipates for lack of energy (pressure) and stress (sand packing).

Turning now to the drawings, FIG. 1 is method 100 of analyzing and controlling hydraulic fracturing. In some examples, the method 100 may include a real-time work flow for hydraulic fracturing including to give complex shear fracturing.

At block 102, the method includes reviewing and planning a hydraulic fracturing job to be implemented. For instance, well logs may be checked to determine if fractures may be initiated in laminated rock to create complex shear fractures. The review may consider analyses of core samples. For example, the review may calibrate computed tomography (CT) scans of log-measured laminations in core-samples. Moreover, in one example, the review at block 102 may determine or compute complete wells that are at least 90% optimal before designing well spacing. The planning may consider several factors. For instance, if the dominant fracture geometry is planar tensile fractures, then fractures may extend large distances and heights while delivering poor recovery efficiency. A factor for better well productivity and recovery can have high fracture density near wells such that more oil and gas may be recovered. In some embodiments, well spacing is to be controlled via the dimensions of hydraulically shear-fractured rock-volumes.

Completions may provide a wide range of production profiles with at least about 70% of well length contributing to production.

Embodiments herein fracture interactively in response to changing rock properties. Some implementations begin with hardware and frac designs but with no plan to adjust the fracing operation in real-time. A particular example of a planned implementation is: about 65 fracturing stages per 10,000 feet well; fracturing stages at least about 120 feet in length with approximately 30 feet to 50 feet (e.g., 40 feet) between stages; and 5 to 12 perforation clusters per stage. Additional planning for this particular example may specify to introduce at least about 2000 pounds of sand per foot of 80% or more 100-mesh frac sand, and 0.5-3.5 pounds of sand per gallon of water (e.g., slick water or friction reducer). The plan may be to employ a friction reducer such as high-viscosity friction reducer (HVFR) at concentrations of at least about 0.5% while fracturing. Higher HVFR concentrations can be used to encourage tensile fractures that can be filled with larger mesh (e.g., 30/50 mesh) in NWB regions to assist production and prevent proppant flowing back into the well. In some examples, proppant sizes are generally between 30-200 mesh (595-74 μm). The product is frequently referred to as simply the sieve cuts, e.g., 30-50, 40-70, 100 or 200 mesh sand.

At block 104, the method 100 includes to acquire data. The method may acquire treating pressure data (e.g., as measured at the wellhead or downhole). The frequency of recording the pressure data may be in one-second or smaller time increments for calculations including for calculating how the rock volume is changing during hydraulic fracturing. The acquisition of data may include to transmit data to remote locations. For example, wellhead pressure data collected by a field computer may be transmitted via a satellite antenna to remote computers (see, e.g., FIG. 2). Implementations may acquire digital pressure. The method may sample wellhead pressure (or downhole pressure) every second or similar interval, and transmit the data from field locations to asset team computers to share fracing results and interpretations.

At block 106, the method generally includes to connect the well to the reservoir. The near wellbore (NWB) region may have complicated stresses, cement, and some voids. This complicated region should generally be connected to the producing reservoir with planar, tensile fractures (e.g., 302 in FIG. 3) of limited height and length. Because fracture volumes have not developed, small increases in rate can generate high pressure (e.g., 806 in FIG. 8A) with out-of-pay height growth. Gradual increases in rate (e.g., indicated by 810 in FIG. 8B) should be used to develop in-pay fractures (e.g., 818 in FIG. 8D). High viscosity friction reducer (HVFR) and diverters can both improve completion efficiency NWB. The method may connect hydrocarbon to the NWB of the well (e.g., 304 in FIG. 3) by creating planar fractures 302 that reach into rock "containers" 306 (e.g., filled with complex fractures found in shale beds). A particular implementation is to employ HVFR concentration of at least about 1% to create planar tensile fractures to get past damage nearest the wellbore. In this particular example, pump rates of about 15 barrels per minute (bpm) of fracing fluid may be initiated and do not exceed about 30 bpm until the geological formation breaks and begins taking fracing fluid. In one example with carbonate formations, hydrochloric acid (e.g., 300-400 barrels) may be added to assist formation breakdown. The distributed NWB fluid entry through perforations can be assisted with higher concentrations of a friction reducer (e.g., HVFR) or diverting agents. Examples of an HVFR include cationic polyacrylamide powders, and so on, that are blended with water and can be effective friction reducers. These friction reducers that are slick at low concentrations (0.5 lbs/1000 gals) and viscous at high concentrations (3.5 lbs/1000 gals) may be suited for shear fracturing. Slick waters of various chemistry can be employed. Some friction reducer is generally beneficial.

In an implementation, diverting agents ideally breakdown or are diluted in the time beneficial to stimulate a stage, or some period of time thereafter. A diverting agent may be chemical agent in stimulation treatments (e.g., hydraulic fracturing) to facilitate uniform injection over the area to be treated. Diverting agents, also known as chemical diverters, may function by creating a temporary blocking to promote enhanced rock stress and productivity throughout the treated interval. Diverting agents may be soluble or inert and dissolve with water injection or oil production.

The fracturing pressures should generally not exceed a pressure which causes fractures to break out the top of the producing zone (e.g., less than 150 feet in height). At greater heights, the fracturing energy may not be concentrated enough to optimally or beneficially create complex shear fractures.

Figure 4:
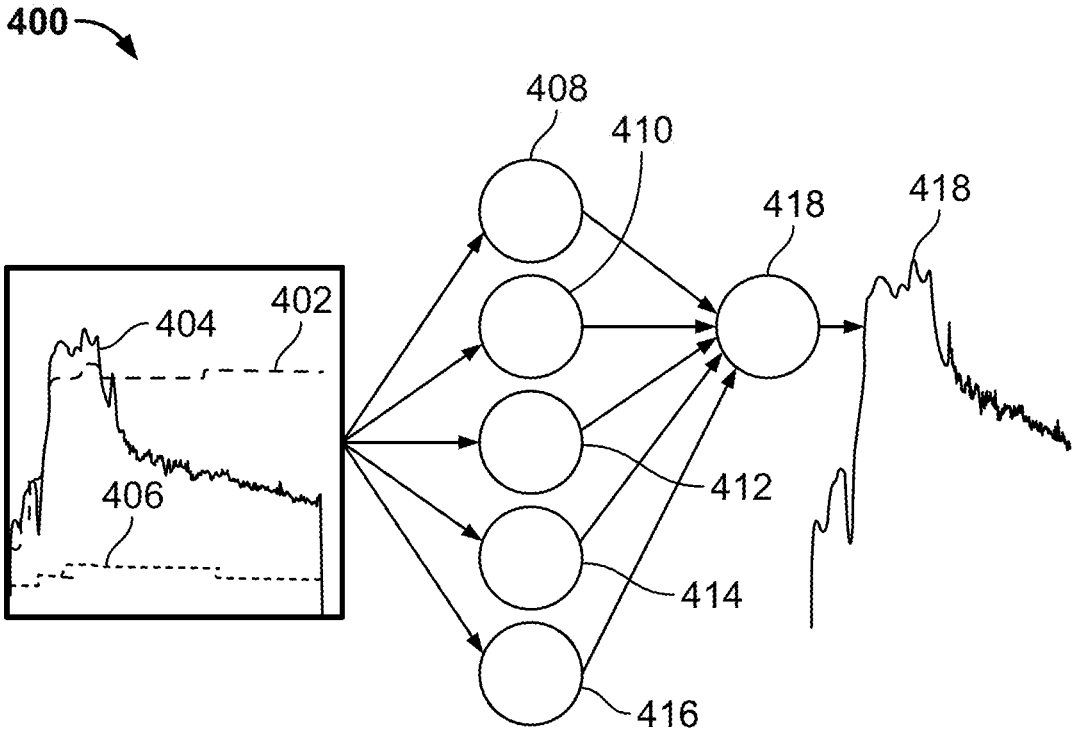
FIG. 4 is a diagram of computer-implemented method for work flow of a neural network in analysis and control associated with hydraulic fracturing.

At block 108, the method includes computing net stress such as with respect to the example of FIG. 4. Net stress may be computed from inputs such as fracing injection rates, fracing treating pressure, and fracing sand concentrations, and so on. Neural networks or other executed computer code may be employed to output net stress, desired pump rate (flow rate of fracing fluid or fracing slurry), or predicted pressure, and the like. Outputs may be relied upon differently. Net stress may be computed to interpret the type of fractures (see, e.g., FIG. 8) that are forming. Neural net rates (e.g., flow rate of fracing fluid output and specified by the neural network) may be relied upon to predict the pressure (e.g., 418 in FIG. 4) that will develop for the type of rock that is present. Treating pressure (e.g., as measured at the wellhead) may be low enough such that fractures do not significantly break out of the top of the pay zone and thus complex shear fractures can generally be controlled in pay. Again, term "pay" may be for localized pay in a particular region.

At block 108, the method may compute pressure patterns (e.g., 418 in FIG. 4), net stress (e.g., 1122 in FIG. 11B), net stress patterns, etc. in real time to manage the fracturing process in real time. Calculations can be automated with neural networks or equations as code executed by a hardware processor, such as with the neural networks discussed in regard to FIG. 4 discussed below. Neural networks (NNs) may be a type of machine learning or artificial intelligence that receives input fluid rate, measured pressure, sand concentration, and other inputs to calculate and rank correlations between input variables, hidden layers, and outputs. As indicated in FIG. 4, hidden layers might represent shale lamination intensity, natural fracture count, rock strength, pore pressure, sand size, and other parameters. An output curve (e.g., 418) could be computed values for parameters including pressure, net stress, or recommended injection rate for achieving shear fracturing, and the like. A neural network may be executable code or computing systems that are a framework for many different machine learning algorithms or procedures to work together and process data inputs including complex data inputs. Such systems may learn to perform tasks by considering examples, generally without being programmed with any task-specific rules. The neural network may do this without any prior knowledge but instead automatically generate identifying characteristics from the learning material that they were trained with.

Figure 9:
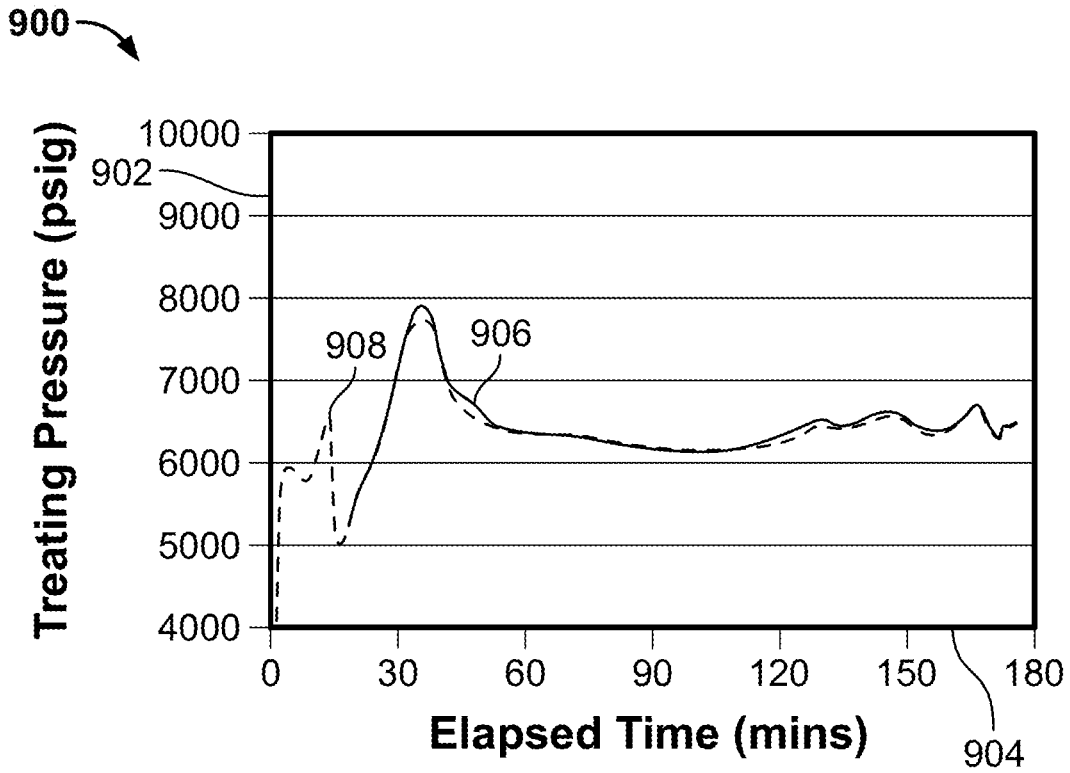
FIG. 9 is a plot of hydraulic-fracturing treating pressure versus elapsed time of the hydraulic fracturing of a geological formation through a wellbore.

The action of making predictions or providing control with the present neural networks may benefit from databases established associated with the hydraulic fracturing data. The database may be generated or the neural network may learn through the first few stages (e.g., first 5, 10, or 15 stages) of the well contemporaneous with the hydraulically fracturing and which the well may have, for example 65 or more stages fractured. The databases may include data acquired from wells that are shear fractured. Data acquired from wells with primarily planar fractures may not have significant or reliable correlations between injection rates, rock properties, and resulting hydraulic fractures. Neural networks can distinguish different rate-pressure and rock classes. See, for example, FIG. 12 and associated discussion, in which the data are from a hydraulically-fractured stage with significant shear fracturing. Time period 1206 is a time of slick water or slick water and acid injection prior to frac fluid entry into the rock. Time period 1208 represents a time of slick water injection after the rock has been entered, but before proppant. Time 1210 represents the time of 100 mesh pumping, and time 1212 is the time of 40/70 sand pumping. Pressure at time 1206 is a measure of the pressure required to enter near wellbore rock. Pressure at time 1208 is the maximum pressure which should not be exceeded to keep fractures in the pay zone. Pressure 1210 and 1212 are selected to optimize the number of shear fractures. The method may employ neural networks to distinguish different classes and to predict or specify treating pressure. The example of FIG. 9 depicts a predicted treating pressure 906 and a measured treating pressure 908. Formation fracturing stress or fracing fluid (or fracing slurry) rates can also be predicted with neural networks. Once NWB connections and real-time calculations are implemented, energy transfer can be improved or optimized.

At block 110, involvement of certain transfer of energy associated the method 100 is presented. Hydraulic fractures may rely on transfer of energy (e.g., 502 in FIG. 5) with fracing fluid (e.g., slick water) to shear rocks apart from inside. Pressure or stress may be a measure of the average energy of a system. Shear fractures may develop at lower pressures than tensile fractures and may be beneficial for transferring energy. Shear fractures typically move more water at lower pressure because the collective shear fractures generally have more surface area than the collective tensile fractures. Again, energy may be transferred by fracing fluid or water such as slick water (e.g., 604 in FIG. 6). Pressure (e.g., 204 in FIG. 2) may be a measure of average energy and a factor to understanding hydraulic fracturing. In general, higher pressure means higher energy and this may be one reason for historical higher than optimal injection rates and hydraulic fracturing pressures. Shale fracturing is generally a complex process with subtleties. For example, shales may delaminate and shear fracture at pressures about 25% below pressures at which planar fractures form from tensile rock failure. Pressure should be focused in pay to increase, improve, or optimize fracturing. A pressure pulse may be a wave (such as a sound wave) in which the propagated disturbance is a variation of pressure in a material medium. Pressure waves or pulses may pass through rock, generating destruction by dilating and slipping shale and other rocks. If too great a rock height is attacked, there may not be enough energy concentrated in pay to cause rock destruction. If planar fractures of great height and width are created, they dissipate frac energy and cause poor energy transfer into shale beds. It is the shale beds and laminations that may respond to adequate fracture intensity and generate surface area to make economic wells. Frac energy should generally be focused, for example, into the shale pores where oil and gas are stored.

As discussed, complex shear fracturing may give a large number of shear fractures (e.g., in a localized region or area) and in which the shear fractures can be relatively small but collectively provide significant or greater surface area. While complex shear fracturing may be referred to as giving high surface area, an individual or single shear fracture in some instances may have less surface area than a planar tensile fracture. Yet, a shear fracture may be characterized as dendritic and with many branches. In general, shear fractures should not be viewed as individual events, but as a system of multiple fractures. A single stress event may represent a shear fracture system with many branches—many small and some large.

At block 112, the method fills and packs sand through the wellbore into the fractures in the hydraulic fracturing. Sand (or other proppants) facilitate creating complex shear fractures. Sand filling of fractures occurs such as described by Bernoulli's principle with respect to FIG. 6. In one example, the sand velocity vector (e.g., 602 in FIG. 6) of magnitude one increases to sixteen 604 in FIG. 6 when the flow opening size 608 (e.g., four) is reduced to flow opening, fracture size 610 (e.g., one). These physics may mean that small fractures have large fluid velocities and are able to pack small fractures—provided that proppants are small enough. Packing small fractures can be beneficial. Small fracture systems created by expulsion of oil or gas from kerogen are typically close together and efficiently connected to producible fluids. Small fracture systems that are sand filled may convert fluid pressure to rock stress. This is work being done on the rock system. When the rock fails, this stored energy is released (e.g., suddenly) separating shales at bedding planes.

At block 112, sand fills and packs into fractures and other voids, for example, as rocks are displaced by slick water and sand injection. Sand transport has historically been described as bed transport with Navier Stokes physics. Bernoulli's principle indicated with respect to FIG. 6 may be an improved explanation of how fine proppants fill and pack hydraulically fractured rock. In some implementations, sand should be small enough to enter the smallest of fractures as feasible in order to fill the small fractures. If a vessel 608 of radius four, flows at rate one 602, when a vessel or fracture size reduces to one 610, then the flow rate 604 becomes sixteen. At high fluid flow velocity, the pressure in front of (leading or downstream of the) sand grains may be low and sand is pulled preferentially into ever smaller fractures. Again, Bernoulli physics may explain how smaller proppants enter small fractures and improve production performance. The idea that large proppants are required to prevent or reduced embedment may be trumped by the benefits of small proppant entering small fractures with large connecting networks. As smaller fracture systems are entered in mid and far field rocks, high flow rates may preferentially sand pack the small or smallest fractures formed from bedding planes and expulsion fractures. Expulsion fractures may be caused by oil and gas expansion as the oil and gas mature from kerogen. These smallest of fractures in sum may have significant or the very largest fracture surface area and connect to pores containing oil and gas.

At block 114, the method generates and relieves stress. In each volume of rock self-propagating, cyclic process may be established: i) fluid enters the rock dilating and slipping fractures and shale beds; ii) sand fills and packs the fractures causing stress build-up; and iii) stress is released (e.g., suddenly) by rock failure or reduced fluid and sand rates, and the like. Stress may be generated as fracing fluid and sand fills small fractures. Conversion of pressure (e.g., 708 in FIG. 7) to stress is doing work and storing energy in the rock. During fracturing operations in the field, there may be increases in stress (e.g., 712 in FIG. 7) which may be observed, for example, as sand concentration is increased. Pressure (e.g., 708) may be decreasing as stress builds. In the implementation depicted by FIG. 7, sand rate was increasing (not plotted), demonstrating that fine sand may facilitate creating and preserving stress. When fractures are close enough for pressure and stress interference between the fractures, the process of stress storage may be active. Decreases in stress 714 occur as the rock fails structurally.

At block 116, the method shear fractures. A goal of hydraulic shear fracturing such as via the Shear FRAC™ technique or other fracturing embodiments herein may be to create more fracture surface area because surface area can correlate (e.g., directly) to well productivity. Types of fractures can include tensile planar fractures (e.g., 814 in FIG. 8C) and complex shear fractures (e.g., 818 in FIG. 8D), and other types. Historically, a goal has been to create planar fractures of significant height and length. To create more stress in pay zones and better connect to where hydrocarbons are stored, shear fractures instead may be implemented. The shear fracturing technique (e.g., Shear FRAC™) may be adjusted frequently as needed (e.g., capable for minute-by-minute adjustments) to measure and maintain beneficial or optimal pressure (e.g., 810 in FIG. 8B) to generate increased or maximum stress in the pay of each well stage. If pressure (e.g., 806 in FIG. 8A) is too high, planar fractures 814 may result. Inspection (e.g., at 818 in FIG. 8D) may show that shear fractures 818 create orders of magnitude more surface area than planar fractures (e.g., 814). Again, complex shear fracturing may create a relatively high fracture surface area (e.g., at 818) by delaminating shales and displacing rocks in three dimensions (e.g., X, Y, and Z directions). When rocks break, the distance between fractures may be approximately equal to bed thickness in some examples. Thus, shales may give high surface area when the shales fracture. Thin laminations may produce rock fragments that can be average size, for example, of sugar cubes. When planar tensile fractures (e.g., 814) are created, fracture surface area collectively is generally less. As analogy, the fracture surface area of a typical room is sum of the surface areas of walls, the ceiling, and the floor. In contrast, consider the increased surface area of that room filled with sugar cubes. Complex shear fracturing may give a large number of shear fractures (e.g., in a localized volume) and in which the shear fractures can be very small but collectively can provide high surface area. While the shear fractures may be referred to as complex shear fractures due to their formation via complex shear fracturing, the shear fractures may be simple shear fractures. Moreover, while complex shear fracturing may be referred to as giving high surface area, an individual or single shear fracture (e.g., as analogous to a single sugar cube) in some instances may have less surface area than a planar tensile fracture (e.g., as analogous to the entire room). On the other hand, a shear fracture may be dendritic and having many branches. This may be labeled as a shear fracture or as multiple shear fractures.

Figure 7:
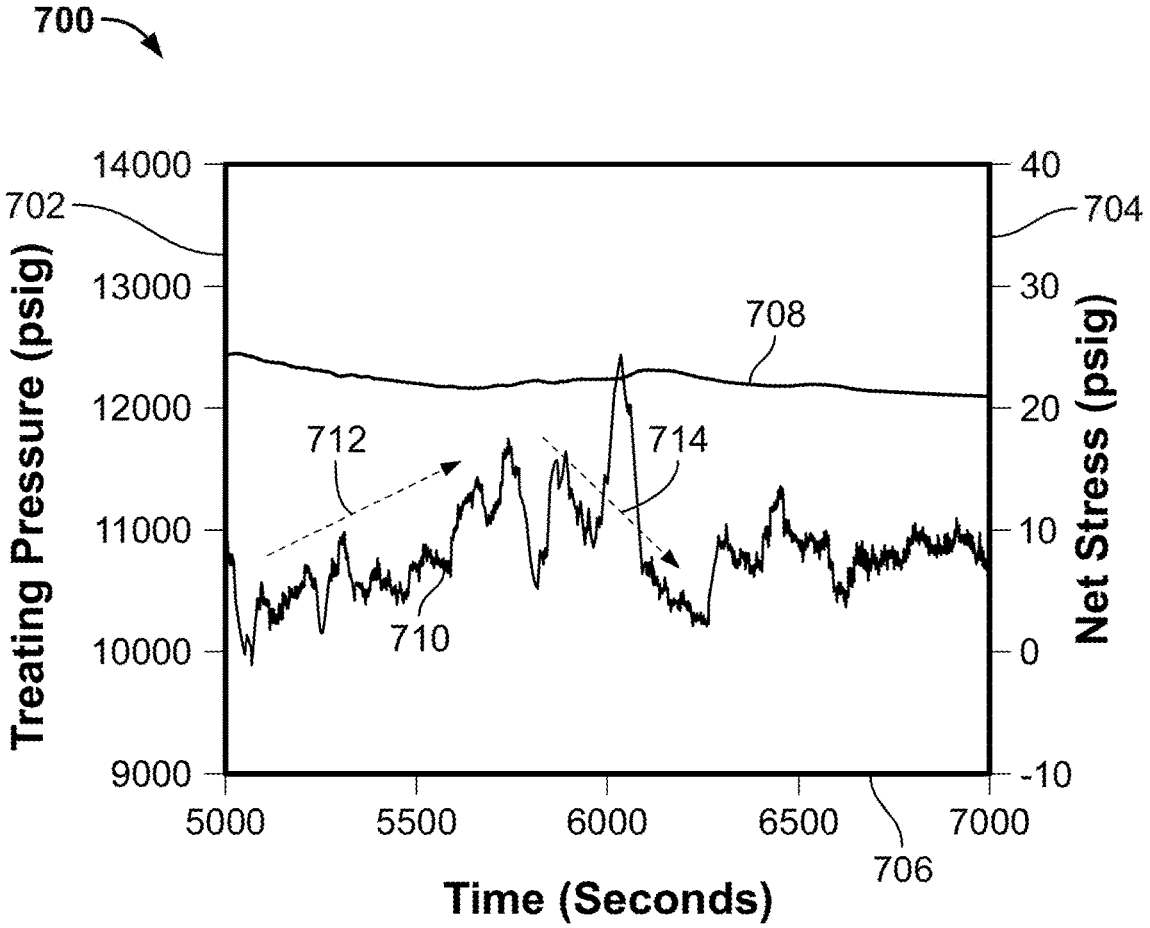
FIG. 7 is a plot of treating pressure and net stress over time in hydraulic fracturing.

Complex shear fractures typically result when fluids enter the rock at a rate approximately equal to the rate at which the rock volume comes apart. When injection rates and resulting pressures (e.g., 806) are too high, planar fractures (e.g., 814) may be dominant. When injection rates are matched to rock weaknesses, the treatment pressure (e.g., 810) may be lower and shear fractures may be in the majority (e.g., at 818). Adjustments to interactive pressure, fracing fluid rate, proppant (e.g., sand), and chemical addition/concentration such as with a friction reducer (e.g., HVFR) may be managed to sustain complex shear fracturing in the field. FIG. 7 shows stress and pressure in a typical shear fractured rock "container." In some examples, shear fracturing may be controlled via gradual or sudden adjustments to operation of the hydraulic fracturing system. For instance, pressure may be ramped up slowly to a typical frac pressure and then reduced slowly by reducing injection rates until cycles of rising and falling stress are observed. Adjustments may be implemented one variable at a time or multiple variables may be adjusted at a time. The magnitude of adjustments can be managed or specified such that adjustments are not too large so that there is primarily complex shear fracturing without significant negative impact on conventional positive aspects of fracturing. The chemical additive(s) (e.g., friction reducer, HVFR, etc.), sand, and other variables, may also be adjusted, including as the fractures propagate and the rocks change. The process can be tuned to compute how much of the time that complex shear fracturing is occurring.

As indicated, the rock around and between wells can constrain or impact the control of hydraulic fracturing. The interpretation of fracture type (e.g., complex shear or planar tensile) may rely on knowledge of the rocks. Completion engineers may be incorrect assessing the presence of shear fracturing. Historically, evidence for significant shear fracturing is usually found in about 1 of 100 wells where pressure and shear fracturing data have been studied. A key performance indicator (KPI) of fracture surface area may be adopted to replace or supplement reports of how much water and sand was pumped. Moreover, in embodiments, less water can be pumped with Bernoulli sand transport relied upon to place small proppant in small fractures. The potential to create larger fracture surface area can be significant.

At block 118, the method may include propagating of the shear fracturing into a new reservoir (space-time) with multiple shear fracturing cycles. It is common to count as many as thirty shear fracturing cycles in a typical well stage. Shear fracturing and micro seismic may correlate pressure-time with space-time in some instances.

At block 120, the method includes cycling the flow rate of fracing fluid (e.g., slick water) and the amount of sand or other proppant. Water rates and volumes have historically delivered a predetermined "sand recipe." For example, a sand recipe may be 2000 pounds of sand per foot of well length. This practice can be improved or supplemented by initiating and propagating pressure or stress patterns indicating shear fracturing. Pressure and stress cycling may involve pumping energy into the reservoir and converting the energy to stress as long as stress can be sustained in each stage. As distance from the well increases, there may not be adequate energy to create complex shear fractures. With respect to the fracing fluid and sand, the cycling of injection rates, pressures, and sand concentration may break rock. In regard to complex shear fracturing, an amount of stress may be maintained on rocks until the rocks fail geo-mechanically. Rocks may fail at particular pressures, allowing frac fluid to enter and stress new containers. A "container" may be defined as a volume of rock observed to have increasing stress 712 of FIG. 7, followed by decreasing stress 714 of FIG. 7. The sizes of containers are a matter of interest as defined by engineers or scientists. They might be 10 seconds or 1000 seconds in time. If containers of 100 seconds are selected at pump rates of 100 barrels per minute, about 166 barrels of fluid are placed. If the fracture volume is 3%, or so of the rock volume, the fractured rock volume would be about 5500 barrels, and so on. The volumes of shear fractured rock can be large enough to contain commercial quantities of hydrocarbon.

At block 122, the method may include balancing treating pressure, or pulsing stress. Balancing treating pressure may involve matching the injection pressure, injection fluid thickness (or viscosity), sand size and sand concentration to propagate shear fractures in rocks as the rock properties may change. Stress pulses might be initiated and propagated by changes to fluid and sand over periods of 10 to 100 seconds, or so on. Balanced treating pressure may be a beneficial condition for creating increased fracture surface area for each well stage. Shear fracturing techniques such as Shear FRAC™ or similar techniques herein may determine the pressure and rate conditions where complex shear fracturing is self-propagating. The result may be that excessive water and sand is generally not be pumped beyond the time when shear fracturing is occurring. There can be significant energy wasted with excess sand and water pumped into planar tensile fractures. Moreover, to interpret hydraulic fracturing pressures, the measured pressure or stress patterns should contain information about the reservoir. Again, an analogy may be interpreting sound waves or patterns of speech. To understand pressure waves or stress patterns emitted or experienced via hydraulic fracturing, embodiments may implement at least the following four actions. First, measure pressure (e.g., at the wellhead) and/or determine net stress in complex fractures (to make rocks speak). Planar-fracture pressure data generally do not contain patterns descriptive of fractures. Second, formulate and incorporate or rely on geologic explanations for pressure and computed stress patterns. There may be thousands of patterns and just a few explanatory models relied upon for interpretation. Third, adjust injection rates, properties, or concentrations of sand, chemical additive(s) (e.g., friction reducer, HVFR, etc.), and fracing fluid (e.g., water or slick water) to achieve complex shear fracturing in changing rock volumes. Fourth, create databases with internal consistency and apply computer implementation to interpret pressure or stress patterns. The technique may shift sand and pressure curves in time.

Figure 2:
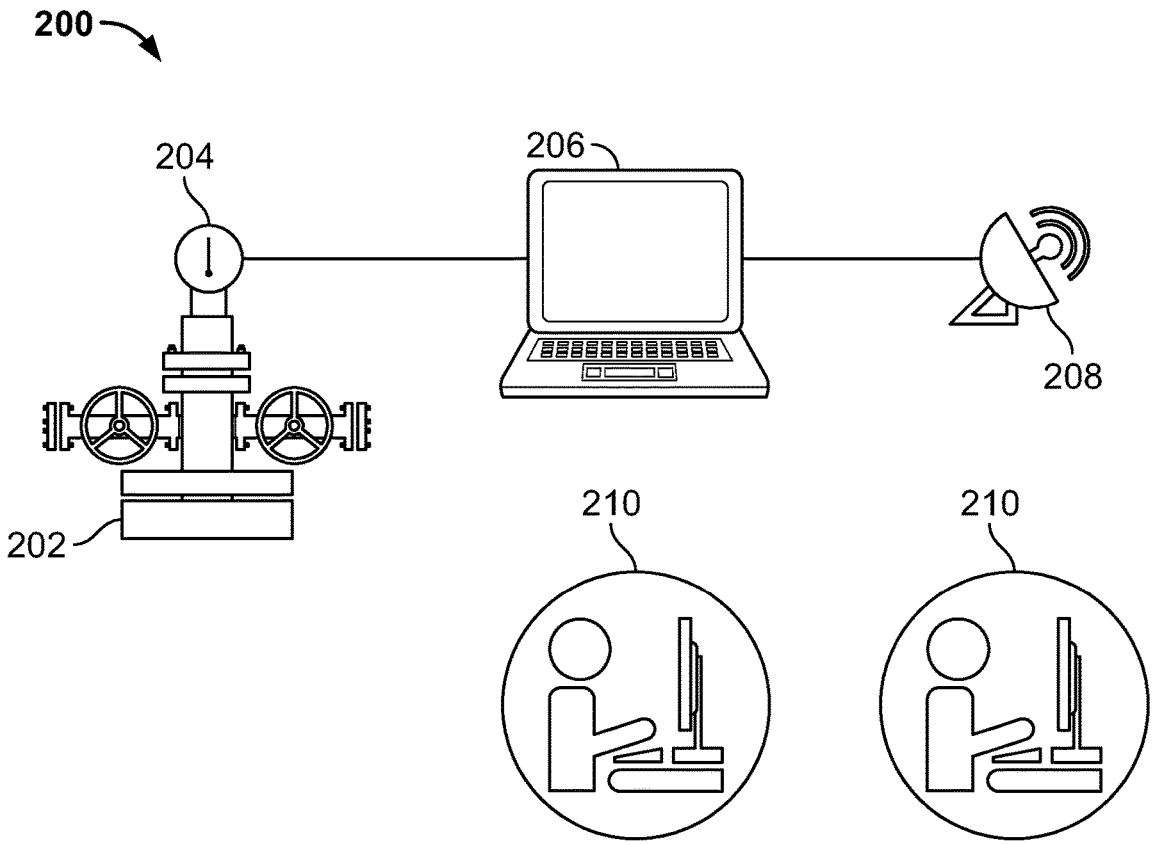
FIG. 2 is a diagram of a data collection system 200 associated with hydraulic fracturing.

FIG. 2 is a data collection system 200 associated with hydraulic fracturing and a wellhead 202. The system 200 is given only as an example and not meant to limit the present techniques. The system 200 may acquire wellhead or downhole pressure data. In the illustrated embodiment, the system 200 includes a pressure sensor 204 at the wellhead 202. The system 200 records wellhead pressure (e.g., via sensor 204), fracing fluid (e.g., slick water) injection rates, friction reducer (e.g., HVFR) concentrations, sand densities, and so on. The data capture may be substantially continuous. For example, the data of wellhead pressure, injection rates, HVFR concentrations, and sand densities may be collected every second or so. In the illustrated example, the data is collected at a field computer 206. The data may be collected at other types of computing systems. The data may be transferred from the field via satellites so data are available, for example, to asset-team offices in real time. For instance, data may be transferred from the field computer(s) 206 via a satellite antenna 208 to a remote computing system(s) 210. Again, FIG. 2 is given only as an example. Indeed, other configurations in addition or in lieu of system 200 are applicable. For instance, a pressure sensor to measure and provide pressure data may be on a discharge of a fracing fluid pump or piping manifold upstream of the wellhead 202. A pressure sensor may also be situated downhole in the wellbore, and so on. The pressure sensor may be disposed at locations along the length of the wellbore and including bottomhole. Furthermore, the computing systems may all be local and without transfer of data to remote locations. Further, the computing may reside on a controller or control subsystem associated with the hydraulic fracturing system, and the like.

Figure 3:
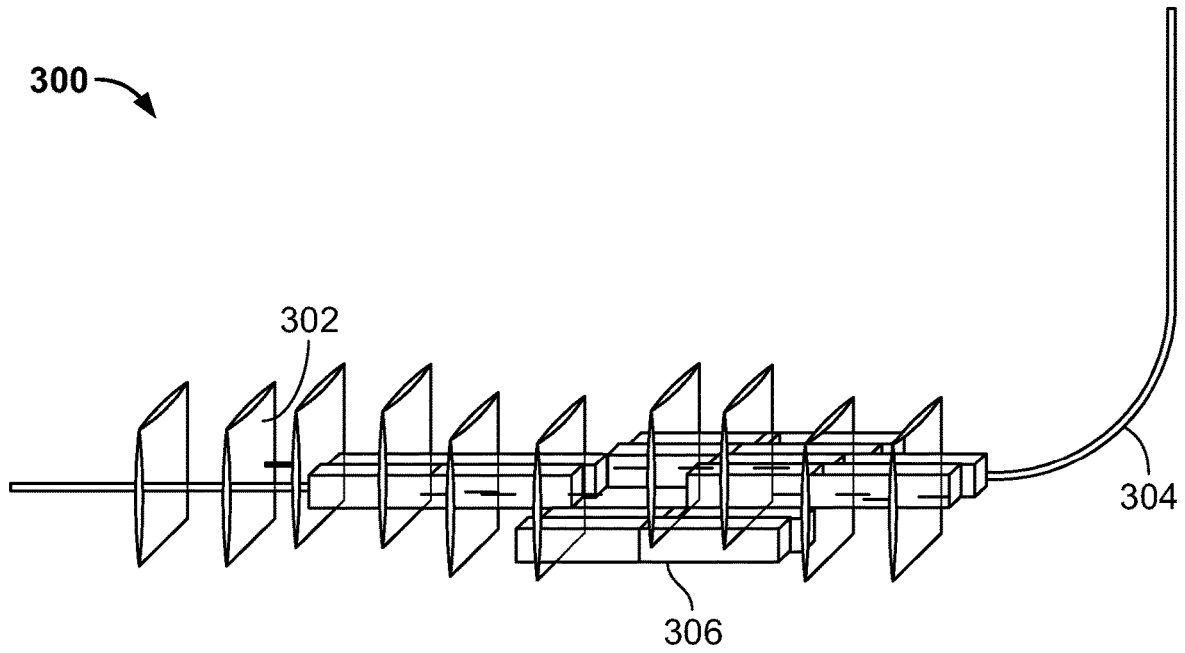
FIG. 3 is a diagrammatical representation of hydraulic fracturing including planar fractures and shear fractures in a geological formation.

FIG. 3 is a simplified representation generally hydraulic fracturing in a geological formation 300. In the illustrated example, planar tensile fractures 302 are in the NWB region that might extend, for example, in the range of 5 feet to 10 feet from the wellbore 304. The planar tensile fractures 302 may be restrained in height to the pay level. Reservoir "containers" 306 are shear fractured. Planar fractures 302 may be created near wellbore to get past drilling damage.

FIG. 4 is a computer-implemented method 400 for analysis via a neural network. Depicted is a neural-network workflow. Net pressure or net stress may be determined via the neural network based on proppant (e.g., sand) and fracing fluid (e.g., water rates), and other properties. The fracing fluid flow rate, fracing fluid pump(s) speed, sand concentration in fracing fluid, sand particle size, and other factors may input or considered. Indeed, input data to the neural network may include for example, injection rates of facing fluid 402, injection rate or concentration of sand 406, measured pressure 404 (e.g., at the wellhead), and other variables. The method may develop correlation equations for hidden layers of the neural network based on the input data. Examples of hidden layers might represent shale lamination intensity 408, natural fracture count 410, rock strength 412, pore pressure 414, and sand particle (mesh) size 416. Correlations (e.g., complex correlations) may be found based on a database(s) constructed to include the factors controlling fracturing.

Neural networks must be "trained" with data which includes examples of all the entire ranges of fracing fluid flow rates, fracing fluid pump(s) rates, sand concentration in fracing fluid, sand particle size, rock types, pore pressure, laminations (or natural fractures) and other factors which may impact hydraulic fracturing. Training of the software involves predicting the rock types first: laminated shales that fracture well, massive non-reservoir rocks that fracture poorly, or a mixture of the two. After the neural network has established the ability to recognize rock types, it can be taught through iteration to recognize shear or tensile fractures and whether they are caused by sand converting pressure to stress, or by rock parting by slick water, and so forth. After the fracture types are identified, the fractures can be quantified to correlate with production, much like a stage-by-stage "production" log.

The Darcy equation is given below for fractured reservoirs and may describe flow in fractured rock using fracture surface area (or connection factor) ($\sigma$) to increase flow rate (Q) when permeability (k) is very low. The flow rate Q may be the volumetric flow rate of fracing fluid which may include or not include proppant, and p is the viscosity of the fracing fluid. Lx, Ly, and Lz are lengths between fractures in the X, Y, and Z directions, respectively. X and Y may be two dimensions parallel with the plane of the Earth's surface. Z may be dimension perpendicular with the plane of the Earth's surface.

$$Q = \sigma \frac{k_{matrix}}{\mu}(P_{matrix} - P_{fracture});\ \sigma = 4 * \left(\frac{1}{L_x^2} + \frac{1}{L_y^2} + \frac{1}{L_z^2}\right)$$

When distances between fractures in the three dimensions (e.g., X, Y and Z directions) are very small, the fracture system surface area and permeability may increase significantly, such as by more than one million times. Small Z distances (height or vertical) caused by laminations may be a significant mechanism for large surface area and permeability improvement specific to shales.

Figure 5:
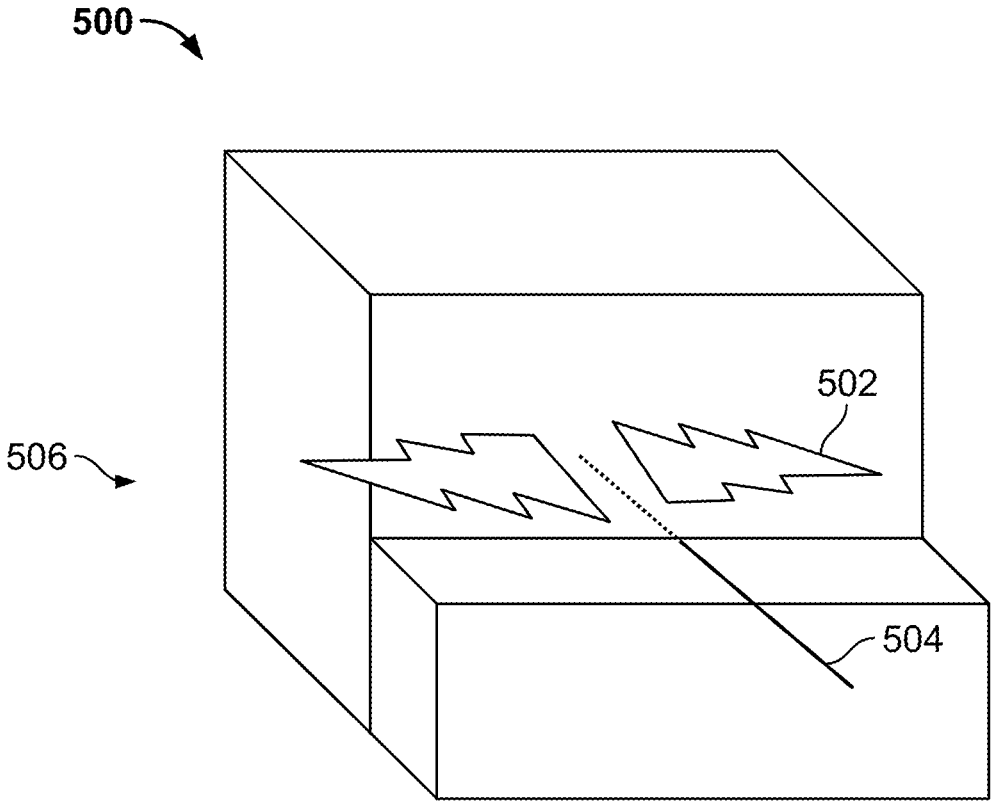
FIG. 5 is a diagrammatical representation depicting energy emanating from a perforated frac stage being fractured.

FIG. 5 is a diagrammatical representation 500 depicting energy 502 emanating outward from a frac stage 504 at a portion 506 of a geological formation being fractured. The energy transfer may be by injected fracing fluid from the Earth's surface through the wellbore and wellbore perforations into the geological formation. The hydraulic fracturing to give fractures may rely on transfer of energy 502 (e.g., via the injected slick water) to tear rocks apart from inside. Keeping energy in pay zones by using laminations to limit or reduce upward growth of fractures may be beneficial.

Figure 6:
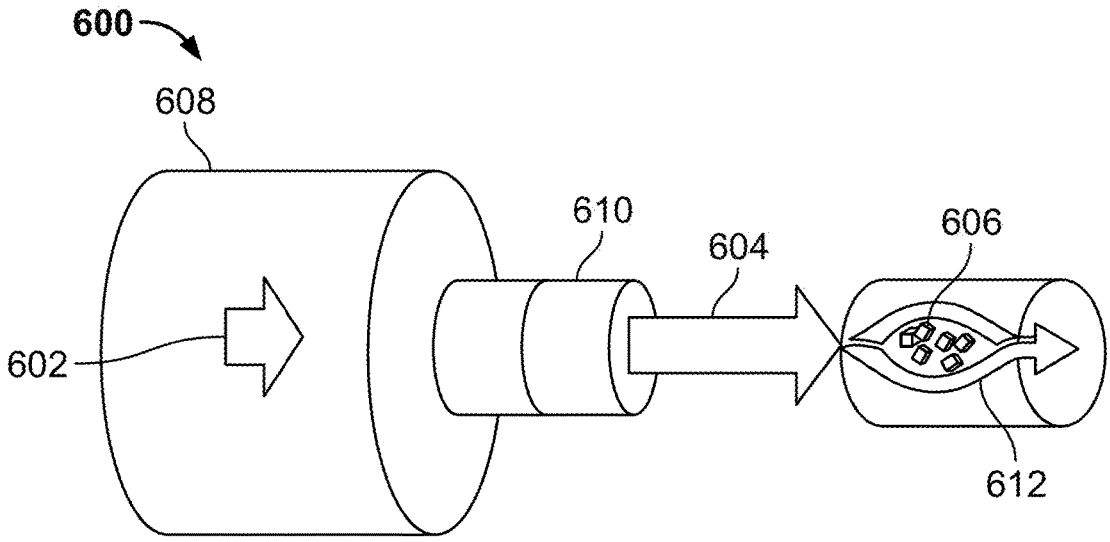
FIG. 6 is a diagrammatical representation that may represent transport and packing of proppant (e.g., sand) in the hydraulic fracturing of a geological formation.

FIG. 6 is a diagrammatical representation 600 that may represent transport and packing of proppant (e.g., sand) in the hydraulic fracturing of the geological formation. The evaluation of the sand filling and packing may consider Bernoulli forces. The physics of this process may explain the packing of small fractures and the build-up of stress with small proppants. Energy may be transferred or applied by fracing fluid 604 such as slick water. Sand filling of fractures may occur. In one example, the sand velocity vector 604 increases in magnitude.

Bernoulli sand packing facilitates understanding fracture sand filling and stress build-up. In essence, the smaller the fracture 610 of FIG. 6, the greater the flow velocity vector 604. As fracture diameters of 608, shrink to diameters of 610, flow of velocity 602 increase to velocity 604. If diameter 608 is four times the diameter of 610, than flow 604 will be 16 times the flow velocity of 602. Flow velocity 612 increases as the fractures become ever smaller, such that downstream of sand grains 606 the pressure is very low—drawing the sand grains downstream. The smaller the fractures and the smaller the sand grains, the greater the packed fracture sand volume per barrel of water injected. Very small expulsion fractures are everywhere from the generation of oil and gas—if they can be sand packed and stressed, surface area is very large.

FIG. 7 is a plot 700 of treating pressure 702 in pounds per square inch gauge (psig) and net stress 704 (psig) over time 706 in seconds of hydraulic fracturing operation. The data reflected in FIG. 7 is exemplary. The "treating pressure" 702 may be the manifold pressure, wellhead pressure, downhole pressure, bottomhole pressure etc. The net stress 704 may be the net stress calculated when treatment pressure and sand rates were normalized to a common scale by the neural network implementation. In particular, the net stress 704 may be the fracture tip stress experienced due to advancing fracing fluid (and proppant). Some implementations calibrate this net stress from a neural network (e.g., by 20 or 30 times) to represent the actual stress required to shear rocks. The net stress 704 may be the net stress applied to or caused in the rock in the formation by the hydraulic fracturing such as via the injected fracing fluid (and proppant). Again, net stress may be defined as the fracture tip stress. The net stress may be impacted by the fracing fluid, proppant, and the rock including evolving changes in the rock.

The plot 700 may indicate the generating and relieving of stress to create shear fractures. The curve 710 is the net stress over time. The curve 708 is the treating pressure such as that measured at the wellhead. The arrow 712 indicates the stress calculations showing the net stress 710 generally increasing with smaller time intervals of increasing (experienced) and decreasing (relieved) net stress. The arrow 712 may be associated with dilation, slip, and sand transfer. The arrow 714 indicates the stress calculations giving values for net stress 710 generally decreasing with smaller time intervals of increasing and decreasing net stress. The arrow 714 may be associated with stress relief and rock failures (including in small containers of rock). Sand is filling fractures and generally building stress through an initial time. Stress peaks and is relieved, creating significant fractures. In this example, there is little variation in pressure 708, but there are sufficient stress responses 710 to interpret how to control fracturing inputs.

In each volume of rock self-propagating, cyclic actions may be established in that fracing fluid enters that rock and shale beds, sand fills and packs the fractures causing stress build-up, stress is released (e.g., suddenly) locally by rock failure or reduced fluid and sand rates, and the like. Stress may be generated as fracing fluid and sand fills small fractures. Indeed, during fracturing operations in the field, there may be increases in stress, for example, as sand concentration in the fractures is increased. Conversion of pressure to stress (e.g., as indicated by 710 in FIG. 7) is doing work and storing energy in the rock. Wellhead pressure, injection rates of fracing fluid and proppant (e.g., sand), addition or concentration friction reducer (e.g., HVFR) may be managed to sustain shear fracturing in the field. FIG. 7 shows stress and pressure in a typical shear fractured rock "container."

Figure 7A:
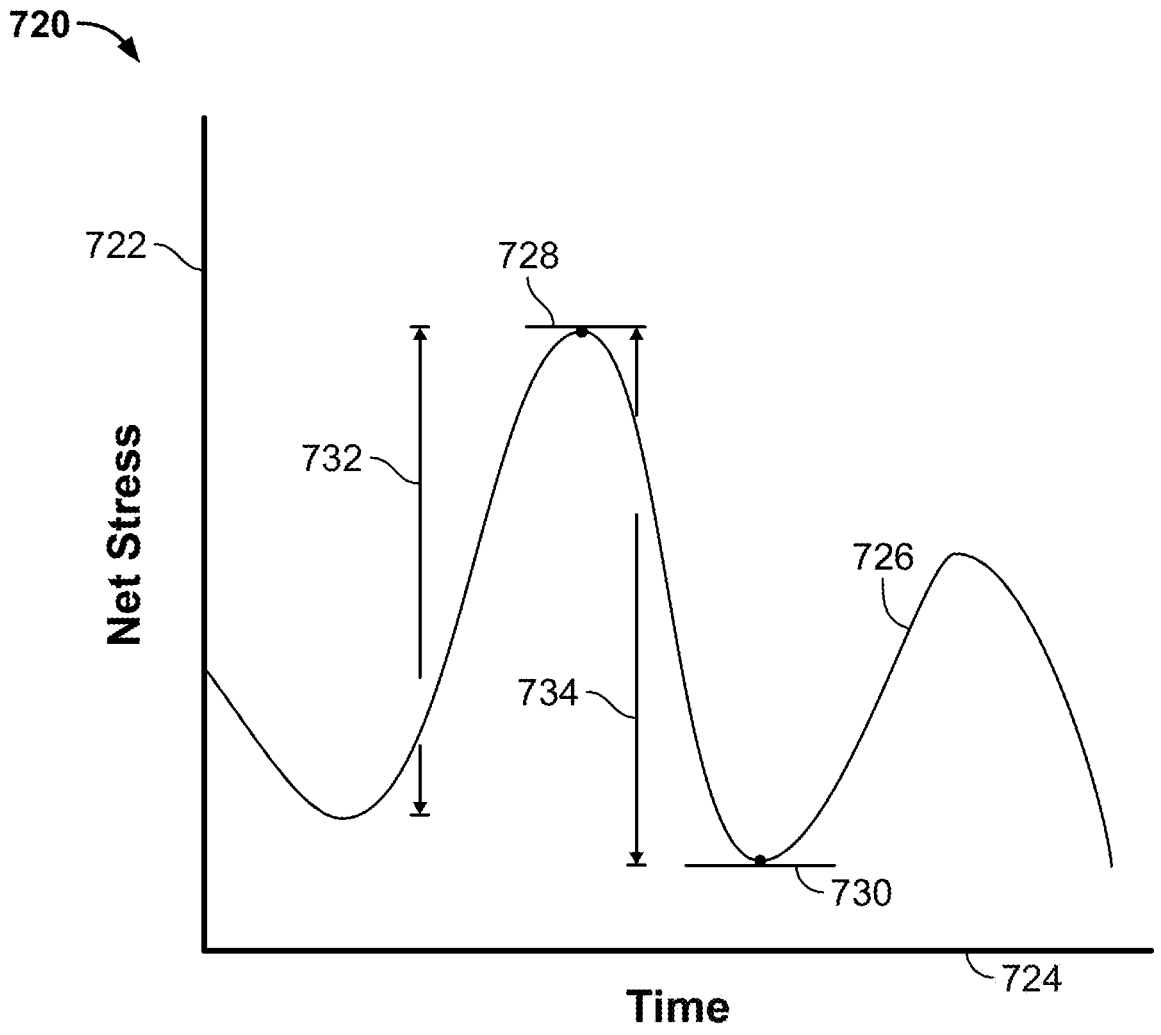
FIG. 7A is a plot of net stress versus time and counting net stress events.

FIG. 7A is a plot 720 of fracture tip stress or net stress 722 (e.g., in psig) versus time 724 (e.g., in seconds), and is provided for a discussion of stress events. The curve 726 is an example net stress over time and given to further explain stress events. As depicted, the curve 726 experiences four stress events which are the net stress changing from decreasing to increasing, or changing from increasing to decreasing. In other words, a stress event is when a slope of a tangent line to the curve 726 changes from positive to negative, or changes from negative to positive. For instance, a stress event 728 occurs when the slope of the tangent line changes from positive to zero to negative. In another instance, a stress event 730 occurs when the slope of the tangent line changes from negative to zero to positive. Other characterizations of stress events may be applicable. Moreover, in general, complex shear fracturing may show up to 100 times (or 1000 times) more stress events as compared to planar tensile fracturing.

The number of stress events per time may be an indication of the occurrence of complex shear fracturing. There may be a positive or direct correlation. In general, the greater the number of stress events per time may be a stronger indication of complex shear fracturing. A threshold (e.g., an average of 3+ stress events per minute) may be specified as a criterion that complex shear fracturing is occurring in determining the presence of complex shear fracturing. To account for noise, a factor (e.g., 0.9, 0.8, 0.7, etc.) may be applied to the number of stress events to give a modified number of stress events to determine the presence of complex shear fracturing. For instance, in one example, where 50 stress events occurred or are occurring in 10 minutes, and a factor of 0.9 is employed, then the modified number of stress events to determine presence of complex shear fracturing is 50/10 multiplied by 0.9=4.5 stress events per minute.

In addition, the magnitude of change in net stress between stress events may be considered. In other words, an increase or decrease in net stress prior to the stress event (since the last stress event) or following a stress event (to the next stress event) may be considered. For example, the magnitude of change around the stress event 728 may be evaluated and impact the determination of the presence of complex shear fracturing. In particular, the magnitude 732 of the increase in net stress prior to the stress event 728 may be considered. Likewise, the magnitude 734 of the decrease in net stress 728 may be considered. In some examples to account for noise or significance, a stress event 734 may be rejected from the stress-event count if such associated magnitude(s) are below a magnitude threshold. In other examples, the values of the magnitudes (e.g., 732, 734) may summed or input to calculations (independent of or related to the count of stress events) to determine the presence of complex shear fracturing. Constructive stress interference can guide sand changes.

Fractures can be identified as a series of positive, then negative slope stress peaks that have stress, or net stress values greater than zero. Shear fractures may begin to form in numbers that are more numerous than tensile fractures when fine proppant is introduced. The first appearance of shear fractures may be evidence that proppant is doing work converting energy to stress. Neural networks (or executed computer code that is not a neural network) may be employed to compute net stress and facilitate varying size or amount of sand that is added to the fracturing or the fracture, e.g., added to the fracing fluid which is pumped. Computed values of stress may be compared to stress computed from wellhead or downhole (e.g., bottomhole) pressure. Computed stress values resulting from fracing fluid may generally indicate tensile fractures. Computed stress values resulting from proppant may generally indicate shear fractures. Computed stress values larger than that of the sum of tensile plus shear fractures may be caused by changes in rock laminations or strength. The number of shear fractures may be the sum curve for the number of shear fractures. Counting the number and types of fractures facilitate control of the fracturing process in real-time to favor the creation of shear fractures. The executed code (stored instructions or logic) of the computer may direct the computer to count the number of shear fractures or shear fracture events, and to count tensile fractures or tensile fracture events?

Figure 8A:
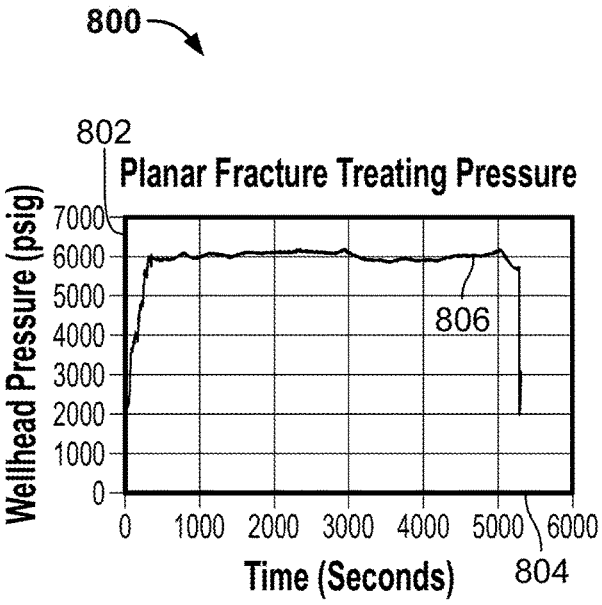
FIG. 8A is a plot of wellhead pressure versus time and depicting an example wellhead-pressure curve as a treating pressure for planar fracturing.
Figure 8B:
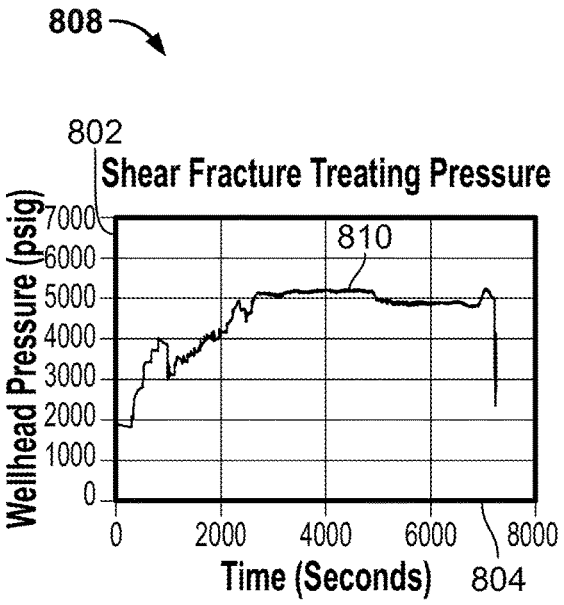
FIG. 8B is a plot of wellhead pressure versus time and depicting an example wellhead-pressure curve as a treating pressure for shear fracturing.

FIG. 8A-8D are given to discuss fracturing with different rate ramps indicated by pressure curves 806 and 810. FIG. 8A is a plot 800 of wellhead pressure 802 (psig) versus time 804 (seconds). Curve 806 is wellhead pressure as the treating pressure for planar tensile fracturing. The data is given as an example. FIG. 8B is a plot 808 of wellhead pressure 802 (psig) versus time 804 (seconds). The curve 810 is wellhead pressure as treating pressure for shear fracturing. The data is given as an example. The illustrated examples give the treating pressure 810 for complex shear fracturing as 70-80% of the treating pressure 806 of the treating pressure for planar tensile fracturing.

Figure 8C:
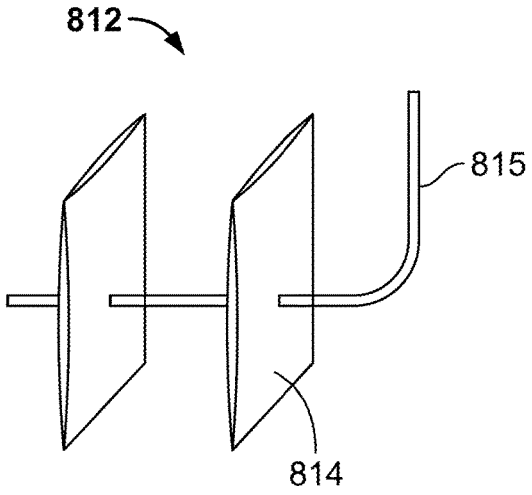
FIG. 8C is a diagrammatical representation of two planar fractures around a wellbore.
Figure 8D:
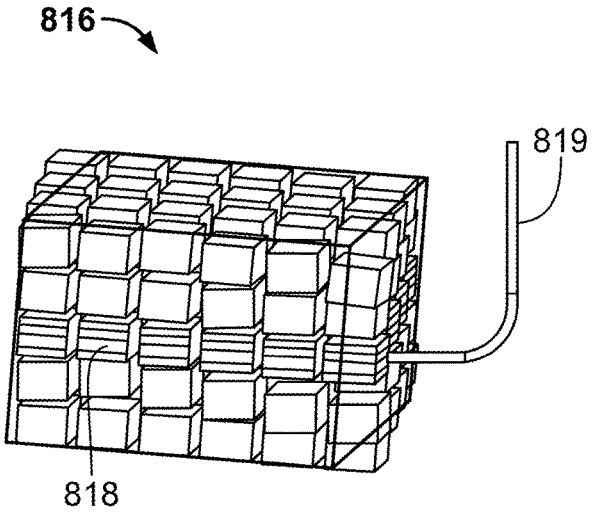
FIG. 8D is a diagrammatical representation of complex shear fractures around a wellbore.

FIG. 8C is a representation 812 of planar tensile fracture 814 around a wellbore 815. A planar tensile fracture may be defined as a fracture with substantial and continued upward growth, not dominated by shale beds. Sometimes tensile fractures are observed in beds with substantial thickness that could not support shear fracturing. Planar tensile fractures 812 may generally extend relatively large distances and heights while delivering poor recovery efficiency. FIG. 8D is a representation 816 of complex shear fractures 818 around a wellbore 819. A complex shear fracture may be defined as a fracture system that is substantially controlled by shale bedding, sufficiently so as to render the shales fractured densely enough to be economically productive. Shear fractures generally cannot be propagated in rocks without the presence of planes of weakness such as are found in shales. Shear fractures could initiate at the interfaces of bedding planes as the rocks are lifted ever so slightly by frac fluid. Bed slip is analogous to playing cards slipping as a deck is bent. With flexure of a thin bed, vertical fractures also develop. Complex shear fracturing may be sufficient fracture density to create commercial production. The rate ramp indicated by the curve 806 in FIG. 8A results in planar fractures 814 with low surface area and generally poor connections to the producing reservoir. In contrast, the rate ramp indicated by the curve 810 in FIG. 8B results in shear fractures 818 having higher surface area and better reservoir connection than the planar fractures 814.

FIG. 9 is a plot 900 of hydraulic-fracturing treating pressure 902 (psig) versus elapsed time (minutes) of the hydraulic fracturing of a geological formation through a wellbore. In this example, the treating pressure 902 is the wellhead pressure at the wellbore. The curve 908 is measured pressure and thus the actual treating pressure. The curve 906 (dashed) is pressure calculated via a neural network. Thus, the treating pressure may be predicted by a neural network, such as the neural network discussed above with respect to FIG. 4. FIG. 9 indicates precision at which neural networks can calculate treating pressure 906 as compared to measured treating pressure 908. Embodiments of the present techniques give innovative correlations to make feasible prediction of pressure with neural networks excluding early in the evolving or elapsed time such 908 such as the first 15 minutes.

Figure 10:
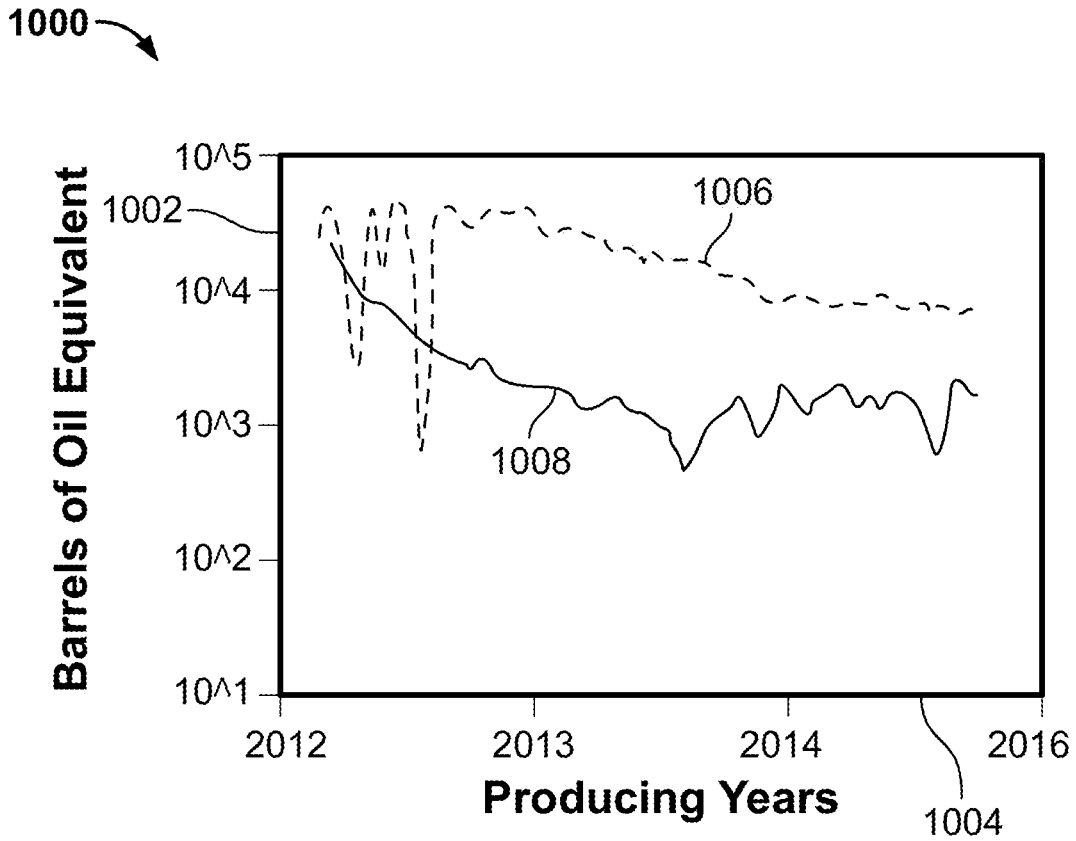
FIG. 10 is a plot of produced oil versus producing years.

FIG. 10 is a plot 1000 of produced oil 1002 (barrels of equivalent) versus producing years 1004. The production 1002 plotted is for well productivity from two side-by-side Lower Eagle Ford shale wells. The high surface-area well 1006 produced 1.14 million barrels of oil equivalent, while the low surface-area well 1008, produced 150 thousand barrels of oil equivalent. Fracture types were interpreted from treating (wellhead) pressure data recorded during hydraulic fracturing. The production of the well 1006 was via primarily shear fractures. The production of the well 1008 was primarily via planar or tensile fractures. The income earned from well 1006 exceeded $50 million. The income earned from well 1008 was about $7.5 million. Shear fracturing commonly increased production by >30% and increases profitability by orders of magnitude, compared to wells with tensile fractures.

Figure 11A:
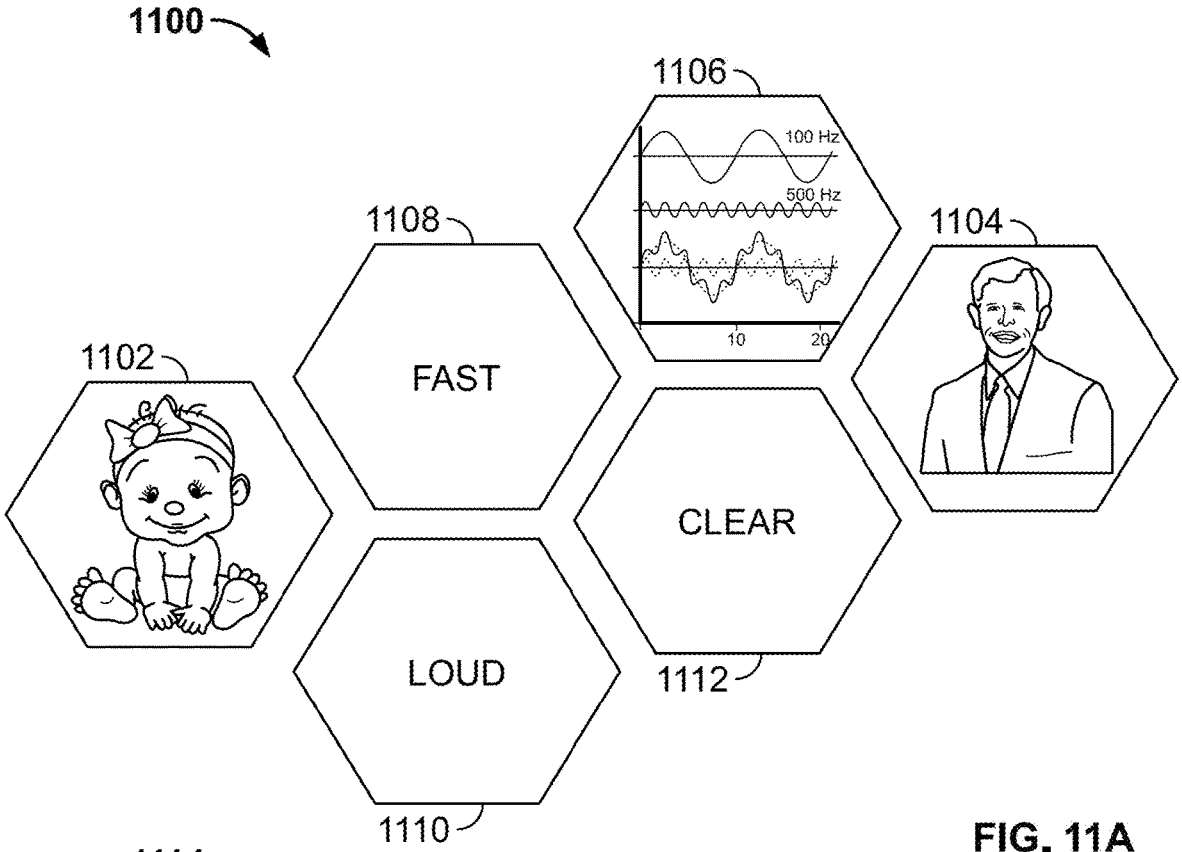
FIG. 11A is a diagrammatical representation for discussion of speech sound as compared to patterns emitted by complex fracturing.

FIG. 11A is a representation 1100 for discussion of sounds waves from speech and net-stress patterns from complex shear fracturing. Human speech 1102, 1104 transmits complex pressure-rich information 1106, 1108, 1110, 1112, etc. and including words and sentences. Such complicated patterns of sound waves may be interpreted by a human mind or by computer. As an analogy, FIG. 11B may be stress-pattern information to be interpreted.

Figure 11B:
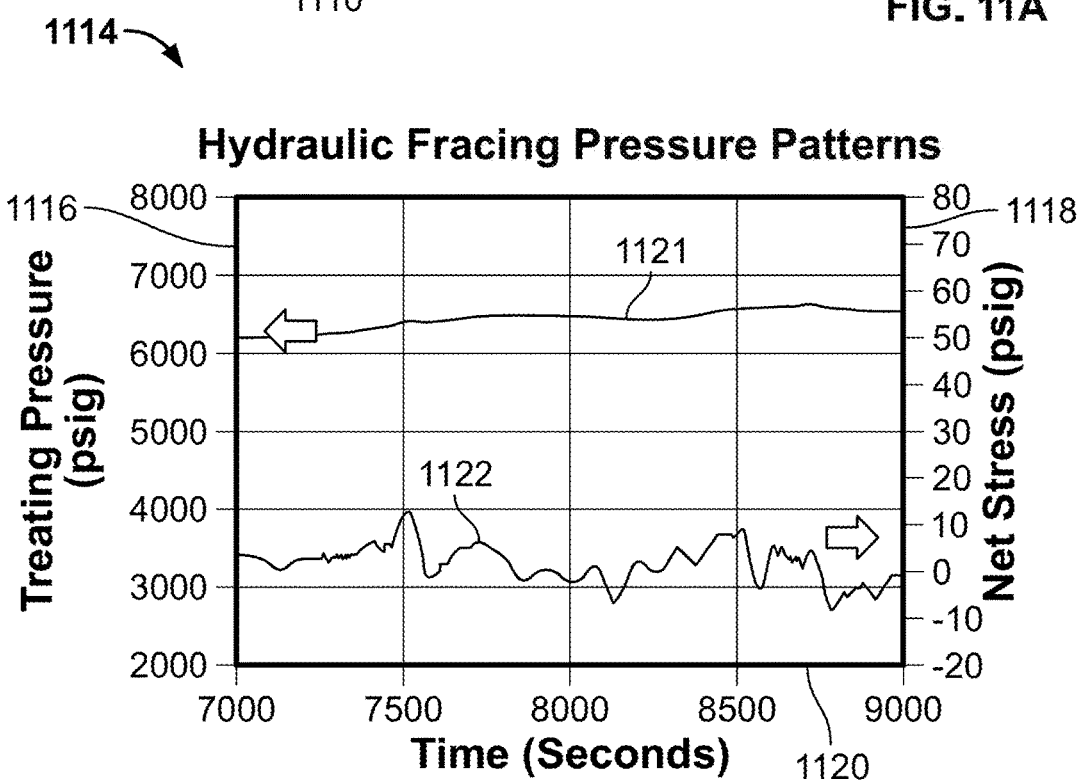
FIG. 11B is a plot of treating pressure and net stress over time.

FIG. 11B is a plot 1114 of treating pressure 1116 (psig) and net stress 1118 (psig) over time 1120 (seconds). The data is given as an example. The curves are for treating pressure 1121 and net stress 1122. Complex fracturing may produce stress patterns rich with information 1122 about whether complex or planar fractures are forming, and whether rocks are laminated or massively bedded. Raw pressure curves 1121 generally lack information to control stress.

Figure 12:
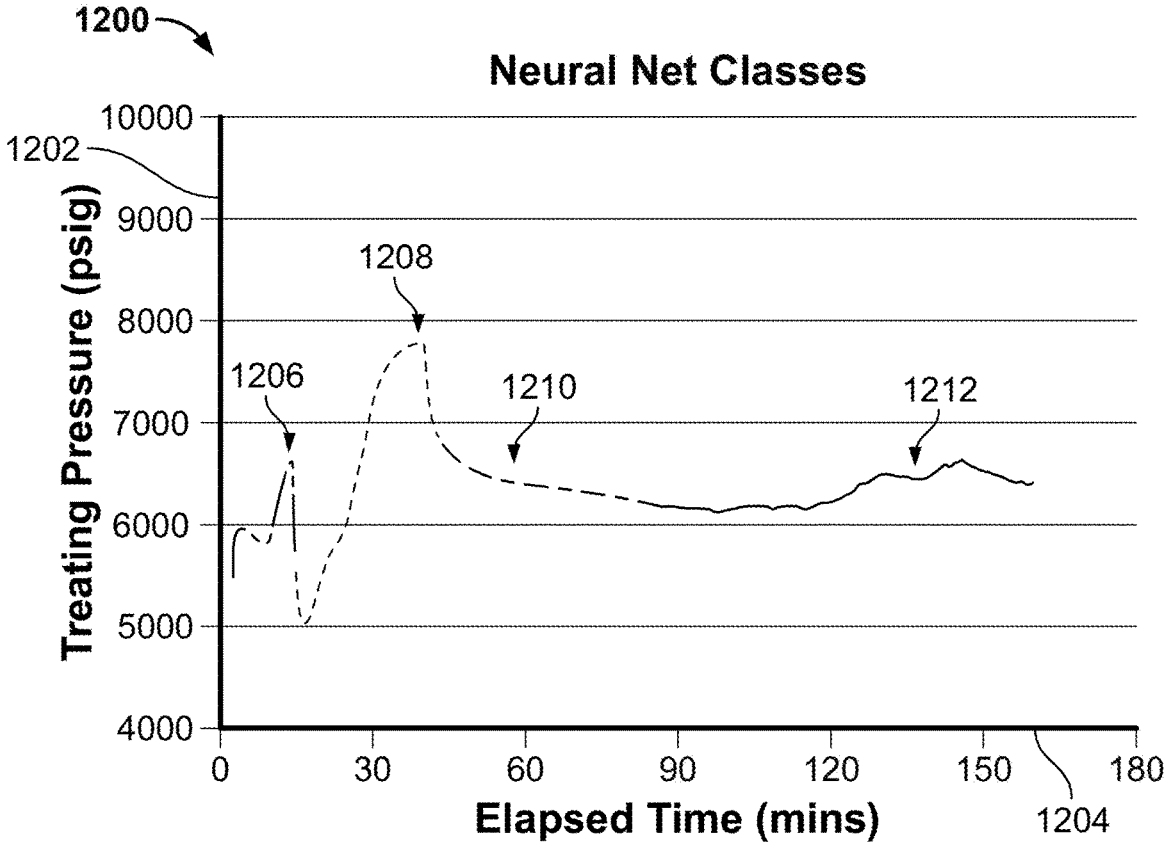
FIG. 12 is a plot of treating pressure versus elapsed time of hydraulic fracturing.

FIG. 12 is a plot 1200 of treating pressure 1202 (psig) versus elapsed time 1204 (minutes) of the hydraulic fracturing. The plotted data is given as an example. FIG. 12 indicates neural-network classes and that neural networks can distinguish different rate-pressure and rock classes. The plotted curves have different line types imposed on treating pressure to show different parts of a treating curve. During the time region 1206, a curve portion of long and short dashes indicates a rock type corresponding to slick water was injection at 15 to 30 bpm. During the time region 1208 a short-dashed curve portion shows a rock type matching the time of slick water was injection between 30 and 90 bpm. During the time of rock type 1210, mesh sand was injected. During time region 1212, 40/70 mesh sand was injected. These data are from a hydraulically fractured stage with much shear fracturing and the data serve to indicate neural network implementation is able to self-organize to recognize different classes in the data, representing parts of a hydraulic fracturing job. When classes can be observed in the data, it is commonly possible to predict other job attributes like desired injection rates, sand concentrations, and fluid viscosity, and so forth. Neural networks have the added advantage of forward prediction beyond the time recorded in the training data. In other examples, neural networks are not employed. Instead, for example, correlations as executed code are utilized.

Implementations include a system and method to acquire and interpret pressure data to identify complex fractures and planar fractures. Pressure data can originate from wells which have been shear fractured. In some implementations, only pressure data from wells that have been shear fractured is utilized. Planar tensile fracture pressures typically do not readily describe rock or fracture systems. In one example, pressures should generally be measured on the entire fractured rock volume—not on cores or from logs or small-scale pressure pulse tests. In one example, pressure is measured with a pressure sensor or gauge(s) to obtain pressure data at a given frequency. The pressure may be measured every second or every few seconds, or at an interval that is a fraction of second, etc. Indeed, one second or other relatively high-frequency data may be utilized to compute shear stress including while adjusting pressure, injected fluids, and proppants.

The system and method may calculate net stress (e.g., 1122 in FIG. 11B) with neural networks, machine learning, artificial intelligence or empirical equations, and so on. The technique may correlate changes in rocks, proppant properties, injection rates, and measured pressures to changes in stress. Energy transferred (e.g., 502 in FIG. 5) by slick water or other fracturing fluid is converted to stress 712 by fine proppants (e.g., fine sand) until the rocks fail including shear fracturing the rock.

Implementations include a system and method to distinguish planar fractures (e.g., 814) from complex shear fractures (e.g., 818) based on computed net stress patterns. Forming planar tensile fractures generally give computed high stress values, driven by high pressure (e.g., 806) per volume of injected fluid. By contrast, the forming of shear fractures typically show lower pressures (e.g., 810) with fracture patterns for: dilation (e.g., at 712), slip (e.g., at 712), sand filling (e.g., at 712), sand packing (e.g., at 712), stress build-up (e.g., at 712), and stress release 714 causing shear fracturing (e.g., 818). Stress fracture patterns are employed to identify and self-propagate shear fracturing 712, 714.

The system and method may compute real-time injection rates (e.g., of fracing fluid and proppant rate or concentration) to obtain desired treatment pressure (e.g., 418 in FIG. 4) to generate shear fractures in the field. Neural networks (e.g., including machine learning, artificial intelligence, etc.) and/or empirical equations are employed to compute the injection rates. Changes in rock, fracing fluid rates, and proppant (e.g., sand) weights are correlated. Data is collected in real time or substantially continuously (e.g., at least every second), such as the wellhead pressure measured via pressure sensor 204 which may include a pressure gauge. The data may be digitally collected. Pressure and downhole sand data are aligned in time for training databases. For a range of expected geology (laminations or massive beds, weak or strong rocks, thin or thick reservoirs, etc.), water rate, sand concentrations, and pressure may be stored in a training database. The neural network or similar logic may find correlations 408, 410, 412, 414, 416 (e.g., complex correlations) to predict pressure and calculate or determine net stress.

Embodiments may interpret geology from stress patterns (e.g., net-stress patterns) caused by changing rocks, proppant, injection rates, and injection pressure, and the like. Man-made patterns caused by pump rates and sand changes can be interpreted. Geology patterns from thin pay, intense laminations, connected faults, shear fractures, and planar fractures can be interpreted via computed stress with selected data in accordance with embodiments herein. Shear stress patterns can be seen between wells in the same pad if the wells are spaced appropriately.

Embodiments may reduce screen outs by generating more fracture (e.g., 818) volume per barrel of injected water with complex shear fractures, compared to the fracture volume for planar fractures (e.g., 814). Because complex shear fractures collectively generally have more volume, they can take comparatively more sand in some implementations and screen out in about 1 per 500 stages, compared to 1 per 100 stages with planar fractures, for example.

Embodiments may contain most or all fractures in pay throughout frac time for some examples by placing wells in highly laminated rocks (e.g., FIG. 8D) and slowly raising injection rates (e.g., indicated by 810). Frac pressures (treating pressure or wellhead pressure) should be raised (e.g., via fracing fluid flow) without creating out-of-pay planar fractures (e.g., 814) where feasible. Actions may start pump rates at about 15 barrels per minute (bpm) or less until acid is introduced. Then, slowly increase rates up to 30 bpm maintaining pressure and rate profiles rising in concert (e.g., see 810). At about at least 50 bpm, start adding fine sand (e.g., 100 mesh) to start shear fracturing. Proceed to normal injection rates of 80-90 bpm, and the like.

Embodiments may test or determine whether increased shear fracturing corresponds to increased production. Production (e.g., 1006) from a shear fractured well as compared to production (e.g., 1008) from a planar fractured well. As discussed, the curves in FIG. 10 are for two respective wells that are side-by-side in a pad with 40 feet difference in vertical elevation. Both wells were fraced the same or similar way. To compare shear and tensile fracturing, put one well in a highly laminated zone and shear fracture it. Place a second well in a different zone with fewer laminations and create planar fractures. Use the same hardware and sand weights. Control rates to shear fracture the laminated well. Pump at higher rates to tensile fracture the second well. Measure production and pressure for about six months and compute fracture surface area for both wells using rate transient analyses. Determine if production volume is related to fracture surface area.

Embodiments may convert pressure to stress using small proppants of 100 to 200 mesh size, or smaller. Place and pack small proppants in fractures to prevent or reduce excess fluid leak off and to build stress within rocks. Facilitate that the proppants are smaller than the smallest fractures. It may be beneficial to fill expulsion fractures with proppant because they are connected to where hydrocarbons are stored. Expulsion fractures are fractures caused as kerogen converts to oil and gas with time and pressure. Small proppants have the ability to convert slick water pressure into stress by holding rocks in place until the rocks fail and shatter. In one example, place at least about 2000 pounds (lbs) per well foot of fine sand and at least about 5000 lbs of sand (e.g. 30/50 mesh or larger) to keep the fine sand from producing back into the well.

Embodiments may fill most or all existing voids with one or two well volumes of water or fracing fluid before fracturing. Liquid filling prior to fracturing may facilitate that pressure and energy are efficiently transferred.

Embodiments may include a Key Performance Indicator (KPI) was developed based on fracture surface area per completion $ spent. Total well fracture surface area is computed using rate transient analyses. Replace sand weight and water volume metrics as measures of success. KPI's should relate money spent to production performance to help guide improvements to completions. Completions success is currently linked to the amount of sand placed safely, at the lowest possible cost. Completions success could be correlated to fracture surface area per $ spent.

Embodiments may employ precision geo-steering to stay in targets within +/−five feet vertically in the desired stratigraphic zone. Know which stratigraphic layer the well is drilling and stay in the most laminated interval to enhance fracturing and productivity. Although actual well position uncertainty is +/−40 feet for a 10,000 feet well, stratigraphic layer can be known precisely from well logs. Rely on gamma ray logs to map the stratigraphic layers. Logging tools should be within 25 feet of the bit for steering precision. Steerable bits able to build angle up, down, left or right, may be employed.

Embodiments may maintain near well bore (NWB) flow efficiency through damage. When wells are drilled and cemented damage can extend as much as 10 feet from the well. This NWB zone should generally transfer frac fluid and sand relatively evenly from perforation clusters and be open for production. This is a location where tensile fractures packed with sand (e.g., 40/70 mesh or larger) may be desired. Inject at initial rates of 15 bpm or less and pump about two wellbores of high-viscosity friction reducer carrying sand (e.g., 40/70 mesh). Place these tensile fractures without exiting the top of the pay, then resume the pumping program as discussed above with respect to containing fractures in pay.

Embodiments may identify fracturing processes for computing systems and training neural networks, machine learning, or artificial intelligence logic or code. Data may be prepared with the pressure and proppant concentration data synchronized. The computing system with executed neural network is then provided data from periods of early fracing fluid (e.g., slick water) injection and complex shear fracturing with sand (e.g., 100, 200, and 40/70 mesh sand). This neural network or other logic is "trained" to find correlations with data from multiple time periods. The neural network and training may be self-organized and employed to predict "classes" (e.g., 1206, 1208, 1210, and 1212 in FIG. 12), The computer-implemented technique may be successful with automated process identification, and the computer with its executed neural network can be trained for calculations such as predictions of fracing-fluid flow rate and expected treating pressure by rock type and proppant Embodiments may predict pressure (e.g., 906 in FIG. 9) from correlating pump rate (fracing fluid flow rate), frac pressure (treating pressure or wellhead pressure), rock properties, sand particle size, and/or sand concentration (in the fracing fluid), and so on, by adding information to the neural network, machine learning, or artificial intelligence code, and databases. When predicted pressure (e.g., 906) matches or similar to measured pressure (e.g., 908), the computer-implemented neural network may predict pump rates for optimal or beneficial shear fracturing. Such implementation may be in real-time including when the predictive databases (if employed) are complete or near completion. Different or new databases may be implemented in different geologic areas.

Embodiments may optimize or provide for beneficial well spacing including in relying on micro seismic data. Micro seismic data may be utilized to measure well spacing after completions have been optimized with, for example, the 90% shear fracturing completion solution. (Micro seismic data measured in tensile fracture systems may not be an effective measure of well space.) Examples may employ the micro seismic data with pressure-time data to define packed and producing fracture volume (PPV).

Embodiments may increase recovery factor of hydrocarbon in place (HCIP). Indeed, certain embodiments may calculate the HCIP for various radii from the wells. In one example, a plan is to produce adequate amount of hydrocarbon to pay for three times well expenses. This or other calculations may guide the frac area optimization. For instance, model recoveries of 5-15% and apply the PPV to set stimulation radii.

Figure 13:
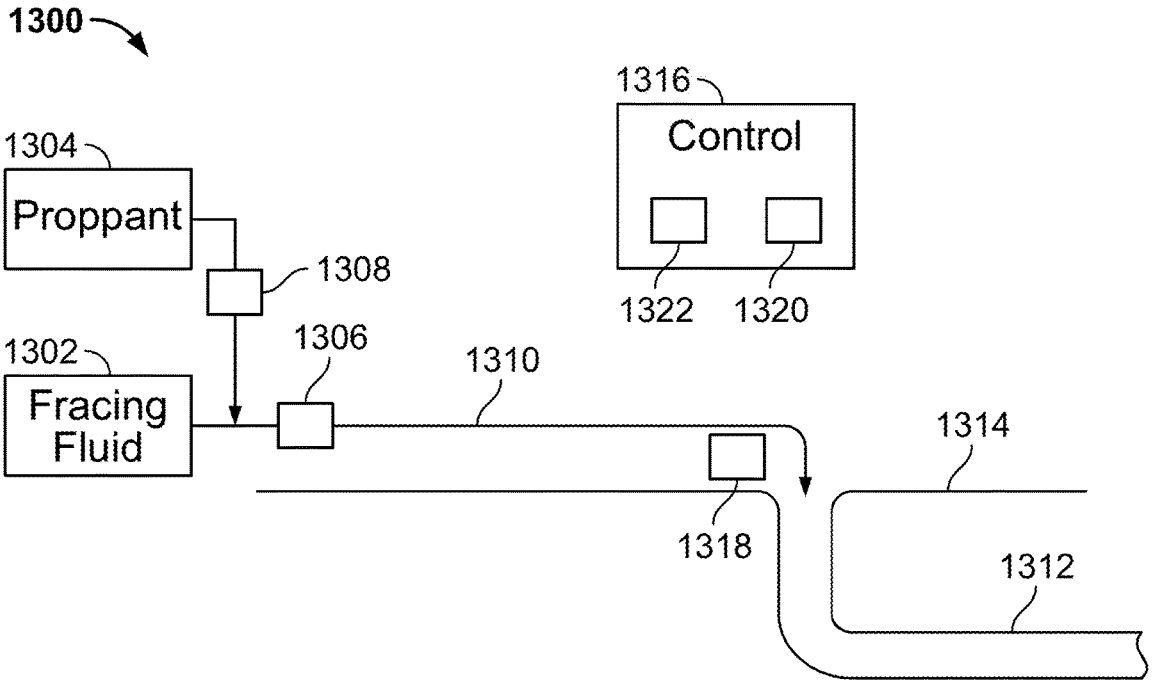
FIG. 13 is a diagram of a hydraulic fracturing system.

FIG. 13 is a hydraulic fracturing system 1300 having a fracing fluid (e.g., slick water) source 1302 and a proppant (e.g., sand) source 1304. The fracing fluid source 1302 may include one or more vessels holding the fracing fluid. The fracing fluid and sand may be stored in vessels or containers and including on trucks in some examples. In some implementations, the fracing fluid is slick water which may be primarily water, generally 98.5% or more by volume. The fracing fluid can also be gel-based fluids. The fracing fluid can include polymers and surfactants. Other common additives may include hydrochloric acid, friction reducers, emulsion breakers, emulsifiers, and do on. The proppant source 1302, can include multiple railcars, hoppers, containers, or bins of sand of differing mesh size (particle size).

The system 1300 includes control devices 1306 and 1308 for the fracing fluid 1302 and the sand 1304, respectively. The control device 1306 may include one or more pumps as a motive device and in which, in some examples, may also be a metering device. The control device 1306 for the fracing fluid 1302 may also include a control valve in some examples. The pumps may be, for example, positive displacement and arranged in series and/or parallel. In some examples, the speed of the pumps may be controlled to give desired flow rate of the fracing fluid. The sand control device 1308 may include, for example, a blender, feeder (e.g., rotary feeder, etc.), conveying belt, metering device, and so on. A blender, for example, may be a solid blender that blends sand of different mesh size. The proppant may be added (e.g., via gravity) to a conduit conveying the fracing fluid such as at a suction of a fracing fluid pump to give a stream 1310 that enters the wellbore 1314 for the hydraulic fracturing. Thus, the stream 1310 may be a slurry that is a combination of the fracing fluid and proppant. For instances when proppant is not added to the fracing fluid, the stream 1310 entering the wellbore 1312 for the hydraulic fracturing may be the fracing fluid without proppant.

Moreover, the wellbore 1312 may be formed through the Earth's surface 1308 into a geological formation in the Earth's crust. The fracing fluid source 1302 and proppant source 1304 may be disposed at the Earth's surface 1314.

The wellbore 1312 may be a cemented cased wellbore and have perforations for the stream 1310 to flow (injected) into the formation.

The hydraulic fracturing system 1300 may include a control system 1316 to direct operation of the hydraulic fracturing system. The fracturing system 1300 generally includes gauges or sensors to measure different operating parameters. For example, the system 1300 may include a pressure sensor 1318 (e.g., analogous to 204 in FIG. 2) disposed at a wellhead (e.g., 202 in FIG. 2) of the wellbore 1312 to measure the wellhead pressure during the hydraulic fracturing. In some implementations, the control system 1316 may receive the measured pressure data and may also consider the wellhead pressure as the treating pressure of the hydraulic fracturing. The control system 1316 may include a computing system 1320 to implement techniques described herein associated with analysis and control. The computing device 1320 may be disposed within a control system 1316, as a field computer (e.g., 206 in FIG. 2), or remote (e.g., 210 in FIG. 2). The control system 1316 may include one or more controllers.

An embodiment is a hydraulic fracturing system including a pump to inject fracing fluid through a wellbore into a geological formation for hydraulic fracturing of the geological formation. The system includes a pressure sensor to measure pressure associated with the hydraulic fracturing. The pressure sensor may be disposed at a wellhead of the wellbore, wherein the pressure is thus wellhead pressure. The fracturing system includes a computing system to determine net stress of the geological formation associated with the hydraulic fracturing and to determine presence of complex shear fractures caused by the hydraulic fracturing and correlative with the net stress. The computing system may have a processor and memory storing code executed by the processor to determine the net stress and the presence of complex shear fractures. The computing system may determine or calculate a set point of an operating parameter of the fracturing system to be specified. The fracturing system may include a controller to adjust an operating parameter of the hydraulic fracturing system in response to the net stress to favor complex shear fracturing over planar tensile fracturing. In some examples, the computing system may direct the controller or be the controller. A set point of the controller or controlled device may be changed or adjusted.

The computing device to determine the net stress may involve calculating, via a neural network, net stress correlative with the pressure and other parameters of the hydraulic fracturing. The hydraulic fracturing system may include a feeder or blender to receive a proppant and discharge the proppant into a conduit conveying the fracing fluid. The aforementioned other parameters may include injection rate of the fracing fluid, injection rate of the proppant, a property of the proppant, or a property of the geological formation at a point of fracturing, or any combinations thereof. Lastly, the computing system to determine the presence of complex shear fractures correlative with the net stress may include determining that a number of stress events per time exceeds a threshold, and wherein a stress event is the net stress changing between increasing and decreasing.

Figure 14:
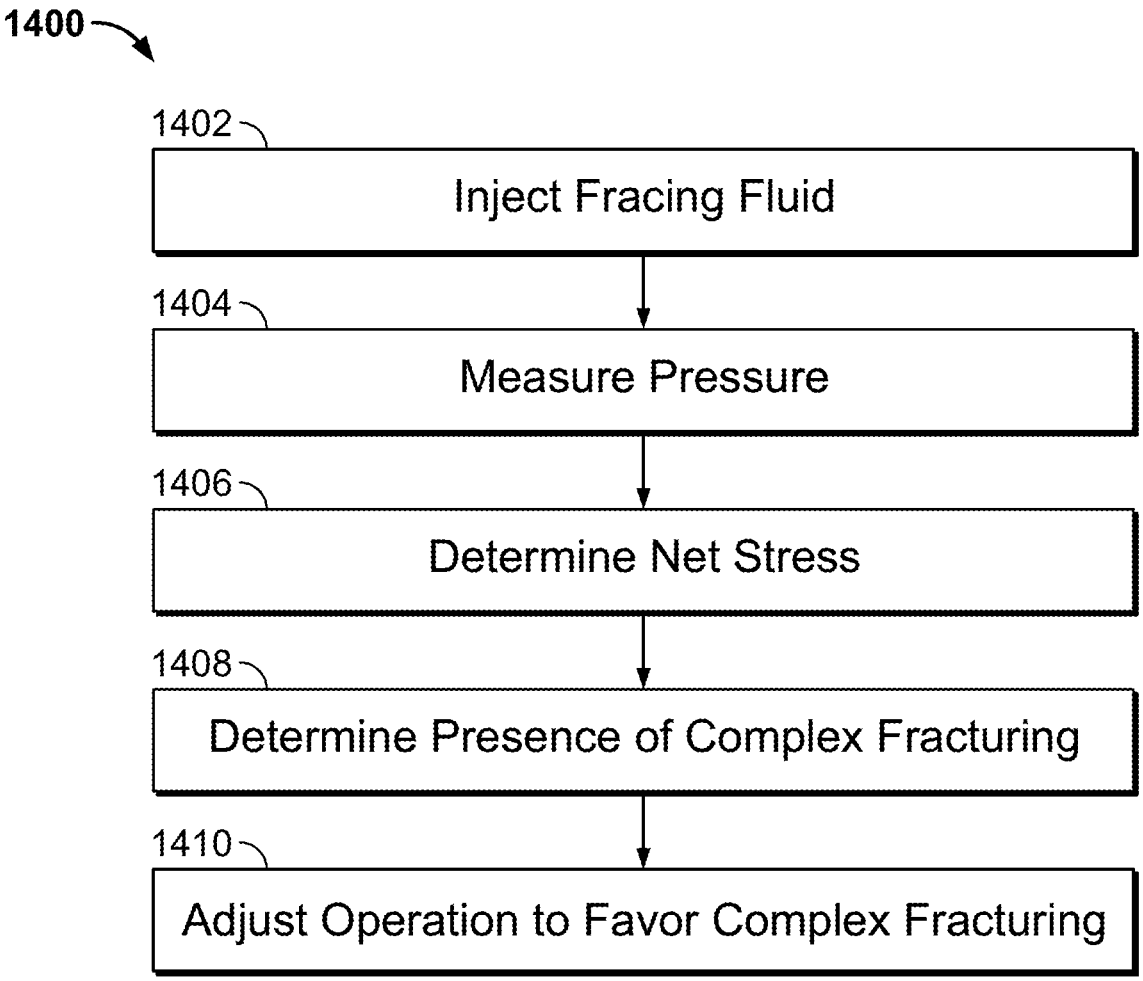
FIG. 14 is a block flow diagram of a method of hydraulic fracturing.

FIG. 14 is a method 1400 of hydraulic fracturing a geological formation (e.g., including shale) in the Earth's crust. At block 1402, the method includes injecting fracing fluid (e.g., slick water) through a wellbore into the geological formation. The injecting of the fracing fluid may involve pumping fracing fluid from an Earth's surface. The fracing fluid may flow through perforations at an interface of the wellbore with the geological formation. The method may include adding a proppant to the fracing fluid and injecting the proppant (e.g., sand) with the fracing fluid.

At block 1404, the method includes measuring pressure associated with the hydraulic fracturing. The measuring pressure may be measuring pressure at a wellhead of the wellbore. The pressure may be measured via a pressure sensor or pressure gauge. The measured pressure may be received at a computing system that analyzes the hydraulic fracturing.

At block 1406, the method includes determining net stress of the geological formation at the hydraulic fracturing. The net stress may be fracture tip stress. The determining of net stress may include calculating, via a neural network of the computing system, net stress correlative with the pressure and other parameters of the hydraulic fracturing. The other parameters may include injection rate (flow rate) of the fracing fluid, injection rate of the proppant, concentration of the proppant in the fracing fluid, a property of the proppant, or a property of the geological formation at a point of fracturing, or any combinations thereof, and so on.

At block 1408, the method may include includes determining (e.g., via the computing system) presence of complex shear fracturing correlative with the net stress. The determining of the presence of complex shear fracturing correlative with the net stress may include determining a number of stress events per time and comparing the number to a threshold. The stress events may include the net stress changing from increasing to decreasing, and also the net stress changing from decreasing to increasing. The number of stress events exceeding the threshold may indicate the presence of complex shear fracturing.

At block 1410, the method may include adjusting operation of the hydraulic fracturing system to favor, promote, or increase complex shear fracturing. The method includes adjusting an operating parameter of the hydraulic fracturing in real time to favor complex shear fracturing over planar tensile fracturing. The method may include adjusting flow rate of the fracing fluid to increase complex shear fracturing. For example, adjusting the flow rate may include adjusting speed of a pump that is pumping the fracing fluid. The method may include adjusting an operating parameter of the hydraulic fracturing in response to the net stress.

An embodiment is a method of hydraulic fracturing a geological formation in the Earth crust, including injecting fracing fluid (e.g., slick water or including water) through a wellbore into the geological formation (e.g., having shale). The injecting of fracing fluid may include pumping fracing fluid from an Earth surface. The method may include adding a proppant to the fracing fluid and injecting the proppant with the fracing fluid through the wellbore into the geological formation.

The method includes measuring pressure (e.g., wellhead pressure, downhole pressure, etc.) associated with the hydraulic fracturing, and determining net stress (e.g., fracture tip stress) of the geological formation associated with (at or during) the hydraulic fracturing. The determining of net stress may include determining real-time net stress of fractures or fracture tips. Indeed, the determining of net stress may include determining real-time stress of fractures or fracture tips at specific times. The determining of net stress may include calculating, via a neural network, net stress correlative with the pressure and other parameters of the hydraulic fracturing. The determining of net stress may include calculating, via a neural network, net stress correlative with the pressure and other parameters of the hydraulic fracturing. Such computer implementation is unconventional in evaluating stress. The other parameters may include flow rate of the fracing fluid, a concentration or density the proppant in the fracing fluid, injection rate of the proppant, a property of the proppant, or a property of the geological formation at a point of fracturing, or any combinations thereof. In some implementations, the determining of net stress is not via a neural network. Instead, for example, correlations or equations outside of the context of a neural network are employed via innovative computer-implementation to determine net stress.

Further, the method includes determining presence of complex shear fracturing correlative with the net stress. The method may determine the presence of complex shear fracturing as dominant or the majority of the fracturing occurring. The determination of dominant or majority may be based on surface area, fracture volume, conductivity, number of fractures, or any combination thereof. Further, the determining of net stress and determining of the presence of complex shear fracturing may include determining real-time net stress of fractures or fracture tips at various times to determine the presence and number of shear fractures in the geological formation during the hydraulic fracturing. Moreover, the determining of presence of complex shear fracturing correlative with the net stress may include determining a number of stress events per time and comparing the number to a threshold. In certain examples, the stress events include the net stress changing from increasing to decreasing, and include the net stress changing from decreasing to increasing. In some examples, the number of stress events exceeding the threshold indicates the presence of complex shear fracturing.

The method may include adjusting an operating parameter of the hydraulic fracturing in response to the net stress. The method may include adjusting an operating parameter of the hydraulic fracturing in real time to favor complex shear fracturing over planar tensile fracturing. The method may include adjusting an operating parameter of the hydraulic fracturing to increase complex shear fracturing. In particular, the method may adjust an operating parameter of the hydraulic fracturing to increase complex shear fracturing by causing constructive pressure and stress pulses at different time frequencies. The operating parameter may include flow rate of the fracing fluid, viscosity of the fracing fluid, or a property of a proppant in the fracing fluid, or any combinations thereof. The adjusting the flow rate may include adjusting the speed of a pump that is pumping the fracing fluid into the geological formation. Lastly, the method may include determining a volume of sand in complex shear fractures, and estimating a stimulated reservoir volume (SRV) based at least in part of the volume of sand.

As mentioned, the determination of complex shear fracturing as dominant or the majority in the hydraulic fracturing may be based on surface area, fracture volume, conductivity, number of fractures, and the like. In some examples, planar tensile fractures are associated with large pressure, large size, and large but unreliable stress values. For instance, if net stress values ranged from 0 to 100 psig, an arbitrary cutoff of say 20 psig may be implemented, so that fractures with stress numbers >20 were tensile. However, in other examples, both shear fractures and tensile fractures are both generally forming at most or all times. Slick water of low viscosity favors the creation of shear fractures. As viscosity of the fracing fluid is increased (e.g., via HVFR or gel), the creation of tensile fractures may be favored. The fabric of the rock can be very laminated as in a shale or massively bedded as in beds a few inches to several feet in thickness. The influence of fine sand may be incorporated into the evaluation. "High surface area" or "highly complex" shear fracturing may occur (favored to occur) with the presence of fine sand that slows or arrests flow of water through the fractures, causing stress to build. As mentioned, fine sand must or may be 100 mesh or smaller for optimal or beneficial stress conversion, although 40/70 sand is perhaps 20% efficient creating stress, for example. This conversion of pressure to stress may cause energy to be stored in the rock until the rock fails.

"High surface area" or "complex" shear fracturing may have at least four conditions: i) laminated shale rock; ii) low viscosity "slick" water (less viscous than 1 centipoise water); iii) fine sand 100 mesh or smaller to stress the rock by entering small, closely spaced fractures and iv) injection fluid rates of frac fluid matching the growth rate of the growing shear fracture network. In a particular example, initial slick-water injection rates begin at 5-15 bpm or so until break down pressure is large enough that fluid can enter the rock. It is common to mix acid with "pad" or clean water to break down cement or carbonate rocks. After breakdown, rates are raised, for example, to 30-50 bpm or so, and 100 mesh sand is introduced at 0.25-0.5 bpm or so. It is at the point of sand placement that the number of shear fractures may exceed the number of tensile fractures. In examples, shear fractures are generally not large. The shear fractures may be on a vertical scale similar to shale bed thickness, and in aggregate perhaps the size of sugar cubes, for example. Yet, the shear fracture network may be very large. In a particular example implementation, the pumping of fracing fluid at 90 bpm, or 1.5 bbls/sec, in 1000 seconds of pump time, 1,500 bbls of fracture volume may be generated. If fractures form in rock of 7% pore volume (porosity) and the fracture volume is 3% of pore volume, then 1,500 bbls of frac fluid fractures a rock volume of about 714,000 barrels every 1000 seconds.

Figure 15:
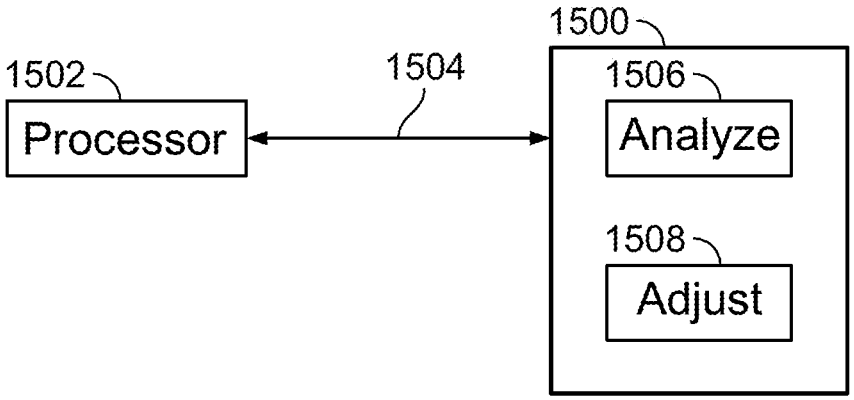
FIG. 15 is a block diagram of a tangible, non-transitory, computer-readable medium that can facilitate analysis and control of hydraulic fracturing.

FIG. 15 is a block diagram depicting a tangible, non-transitory, computer (machine) readable medium 1500 to facilitate analysis and control of hydraulic fracturing. The computer-readable medium 1500 may be accessed by a processor 1502 over a computer interconnect 1504. The processor 1502 may be a controller, a control system processor, a controller processor, a computing system processor, a server processor, a compute-node processor, a workstation processor, a distributed-computing system processor, a remote computing device processor, or other processor. The tangible, non-transitory computer-readable medium 1500 may include executable instructions or code to direct the processor 1502 to perform the operations of the techniques described herein, such as to determine net stress and determine presence of complex shear fracturing, and in some examples, adjust a controller or specify a set point for operation of a hydraulic fracturing system. The various executed code components discussed herein may be stored on the tangible, non-transitory computer-readable medium 1500, as indicated in FIG. 15. For example, an analyze code 1506 may include executable instructions to direct the processor 1502 to determine or calculate net stress and to determine presence of complex shear fracturing based on the net stress (e.g., based on the number of stress events). The code 1506 may include a neural network to determine the net stress (e.g., fracture tip stress). Adjust code 1508 may include executable instructions to direct the processor to specify a set point or adjust an operating parameter of the hydraulic fracturing system, as discussed herein. It should be understood that any number of additional executable code components not shown in in FIG. 1500 may be included within the tangible non-transitory computer-readable medium 1500 depending on the application.

An embodiment is a non-transitory, computer-readable medium including instructions executable by a processor of a computing device to: receive measured pressure data associated with hydraulic fracturing of a geological formation in Earth's crust; determine net stress of the geological formation due to hydraulic fracturing; and determine presence of complex shear fracturing correlative with the net stress (e.g., fracture tip stress). The instructions may include a neural network. Indeed, to determine net stress may include calculating, via the neural network, net stress correlative with the measured pressure data and other parameters of the hydraulic fracturing. The other parameters may include injection rate of fracing fluid, a concentration of a proppant in the fracing fluid, or size of the proppant, or any combinations thereof, and additional parameters. The non-transitory, computer-readable medium may include instructions executable by the processor to specify a set point of an operating parameter of a hydraulic fracturing system performing the hydraulic fracturing to favor complex shear fracturing over planar tensile fracturing. The kind of rock and range of production (relative to type curves) may be predicted from the relative number of shear and tensile fractures.

Figure 16:
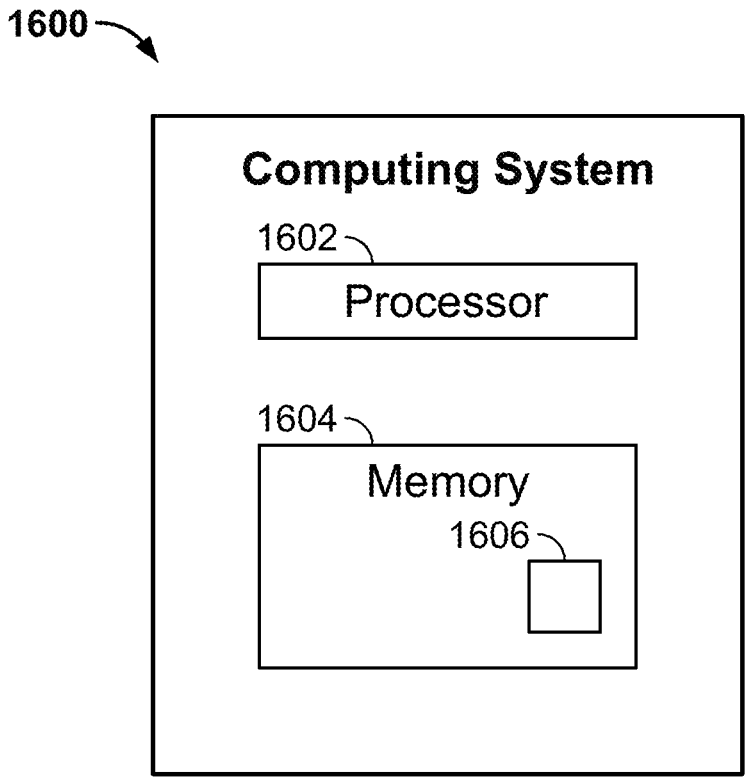
FIG. 16 is a computing system having a processor and memory storing code 1606 (e.g., logic, instructions, etc.) executed by the processor 1602 to compute net stress and, in some cases, recommend or specify values for operating parameters.

FIG. 16 is a computing system 1600 having a processor 1602 and memory 1604 storing code 1606 (e.g., logic, instructions, etc.) executed by the processor 1602. The computing system 1600 may be single computing device or a computer, a server, a desktop, a laptop, multiple computing devices or nodes, a distributed computing system, control system, and the like. The computing system 1600 may be local (e.g., 206 in FIG. 2) at the wellbore or remote (e.g., 210 in FIG. 2) from the wellbore. Indeed, the computing system 1600 may represent multiple computing systems or devices across separate geographical locations. The computing system 1600 may be a component (e.g., 1320 in FIG. 13) of a control system. The processor 1602 may be one or more processors, and may have one or more cores. The hardware processor(s) 1602 may include a microprocessor, a central processing unit (CPU), graphic processing unit (GPU), or other circuitry. The memory may include volatile memory (e.g., cache, random access memory or RAM, etc.), non-volatile memory (e.g., hard drive, solid-state drive, read-only memory or ROM, etc.), and firmware, and the like.

In operation, the computing system 1600 may receive measured pressure data originating from a pressure sensor (e.g., 204 in FIG. 2 or 1318 in FIG. 1318) measuring wellhead pressure and also receive data from other sensors and controllers. The code 1606 may include an analyzer or analysis logic and a neural network when executed that directs the processor 1602 to determine or calculate net stress (e.g., fracture tip stress) and to determine presence of complex shear fracturing based on the net stress (e.g., based on the number of stress events). The code 1606 may include an adjuster or controller which may be instructions when executed that direct the processor 1602 to specify a set point or adjust an operating parameter of the hydraulic fracturing system, as discussed herein. The computing system 1600 is unconventional, for example, in that the computer can determine the presences of complex shear fracturing and also specify adjustments of the hydraulic fracturing to increase or favor complex shear fracturing. In this context, the computer is innovative with respective to accuracy and speed (real time). In addition, the technology of hydraulic fracturing is improved. Further, this innovative computing system results in increased production of hydrocarbon (e.g., crude oil and natural gas) for a well.

Lastly, discussion of exemplary hydraulically fracturing follows. Hydraulic fracturing is used to increase the rate at which fluids, such as petroleum, water, or natural gas can be recovered from subterranean natural reservoirs. Reservoirs are typically porous sandstones, limestones or dolomite rocks, but also include unconventional reservoirs such as shale rock or coal beds. Hydraulic fracturing facilitates the extraction of natural gas and oil from rock formations with too low permeability to produce. Thus, creating conductive fractures in the rock is instrumental in extraction from naturally impermeable shale reservoirs. Permeability can be measured in the microdarcy to nanodarcy range. Measurements of the pressure and flow rate during the growth of a hydraulic fracture, with knowledge of fluid properties and proppant being injected into the well, may provide for monitoring a hydraulic fracture treatment. This data along with knowledge of the underground geology can be used to model information such as length, width, and conductivity of a propped fracture.

Hydraulic-fracturing equipment for oil and natural gas fields may consist of a slurry blender, fracturing pumps (e.g., high-pressure, high-volume) and a monitoring unit. Associated equipment can fracturing tanks, storage and handling of proppant, a chemical additive unit (to provide and monitor chemical addition), and many gauges and meters for flow rate, fluid density, treating pressure, and so on. Chemical additives may be up to 3.5 lbs or greater per 1000 gallons of total fluid volume. Fracturing equipment operates over a range of pressures and injection rates, and can reach up to 15,000 psig and 100 barrels per minute (9.4 cubic feet per second). Purposes of fracturing fluid may be to extend fractures, add lubrication, change gel strength, and to carry proppant into the formation to increase the size of the stimulated, producing volume. Techniques of transporting proppant in the fluid may be labeled, for example, as high-rate or high-viscosity, or low rate, low viscosity. High-viscosity, high rate fracturing tends to cause large tensile fractures. Low rate, low viscosity (slick water) fracturing may cause small high-surface area micro-fractures. Fracing fluid may be a slurry of water, proppant, and chemical additives. Additionally, gels, foams, and compressed gases, including nitrogen, carbon dioxide and air can be injected.

The fracing fluid varies depending on fracturing type desired, and the conditions of specific wells being fractured, and water characteristics. The fluid can be gel, foam, or slick water-based. Fluid choices are tradeoffs in that more viscous fluids, such as gels, may better maintain proppant in suspension, while less-viscous and lower-friction fluids, such as slick water, may facilitate the fluid to be pumped at higher rates to create fractures farther out from the wellbore. Considered material properties of the fluid include viscosity, pH, various rheological factors, and others. As indicated, water may be mixed with sand and chemicals to create fracing fluid. A typical fracture treatment may employ between 3 and 12 additive chemicals. For slick water fluids the use of sweeps is common. Sweeps are temporary reductions in the proppant concentration, which help facilitate that the well is not overwhelmed with proppant. As the fracturing process proceeds, viscosity-reducing agents such as oxidizers and enzyme breakers are sometimes added to the fracing fluid to deactivate the gelling agents and encourage flowback. Such oxidizers react with and break down the gel, reducing the fluid viscosity and facilitating that no proppant is pulled from the formation.

A proppant may is generally a solid material, typically sand, treated sand, or man-made ceramic materials, employed to keep an induced hydraulic fracture open, during or following a fracturing treatment. The proppants may be added to a fracing fluid which may vary in composition depending on the type of fracturing used, and can be gel, foam or slick water-based. In addition, there may be unconventional fracing fluids. Again, fluids may make tradeoffs in such material properties as viscosity, where more viscous fluids can carry more concentrated proppant; the energy or pressure demands to maintain a certain flux pump rate (flow velocity) that will conduct the proppant appropriately; pH, various rheological factors, among others. In addition, fluids may be used in low-volume well stimulation of high-permeability sandstone wells to the high-volume operations such as shale gas and tight gas. The proppant can be a granular material that prevents or reduces the created fractures from closing after the fracturing treatment. Types of proppant include silica sand, resin-coated sand, bauxite, and man-made ceramics. The choice of proppant depends on the type of permeability or grain strength needed. In some formations, where the pressure is great enough to crush grains of natural silica sand, higher-strength proppants such as bauxite or ceramics may be used. The most commonly used proppant is silica sand, though proppants of uniform size and shape, such as a ceramic proppant, may be effective.

An embodiment includes a method of hydraulic fracturing a geological formation in Earth's crust, including: injecting fracing fluid through a wellbore into the geological formation; measuring pressure associated with the hydraulic fracturing; and determining real-time net stress of fractures or fracture tips (e.g., at various times or over various time periods) to determine the presence and number of shear fractures in the geological formation during or at the hydraulic fracturing. The determining of the presence of complex shear fracturing may include determining that complex shear fracturing is dominant (e.g., a majority) in the hydraulic fracturing. The method may include adjusting an operating parameter of the hydraulic fracturing in real time to favor complex shear fracturing over planar tensile fracturing. The method may include adjusting flow rate, fluid viscosity, or proppant properties, or any combinations thereof, of a fracing slurry to increase complex shear fracturing by causing constructive pressure and stress pulses at various time frequencies. The adjusting of the flow rate may involve employing a pump and adjusting the speed of a pump that is pumping the fracing fluid into the geological formation. The method may employ a pressure sensor to measure the pressure associated with the hydraulic fracturing. The method may employ a computing system to determine net stress of the geological formation associated with the hydraulic fracturing and to determine presence of complex shear fractures caused by the hydraulic fracturing and correlative with the net stress. The method may include adjusting an operating parameter of the hydraulic fracturing in response to the net stress, wherein the pressure is wellhead pressure, and wherein injecting fracing fluid (e.g., slick water or including water) includes pumping fracing fluid from an Earth's surface. In examples, the geological formation includes shale, wherein measuring pressure includes measuring pressure at a wellhead of the wellbore, and wherein the net stress is fracture tip stress. The determining of net stress may include calculating, via a neural network or other computer executed code, net stress correlative with the pressure and other parameters of the hydraulic fracturing. The method may include adding a proppant to the fracing fluid and injecting the proppant with the fracing fluid through the wellbore into the geological formation, wherein the aforementioned other parameters may include flow rate of the fracing fluid, a concentration or density of proppant in the fracing fluid, injection rate of the proppant, a property of the proppant, or a property of the geological formation at a point of fracturing, or any combinations thereof. The determining presence of complex shear fracturing correlative with the net stress may involve determining a number of stress events per time and comparing the number to a threshold. The stress events may be defined an event of the net stress changing from increasing to decreasing, and as an event of the net stress changing from decreasing to increasing, and wherein the number of stress events exceeding the threshold indicates the presence of complex shear fracturing. The proppant (e.g., sand) amount or volume in shear fractures may be computed to estimate the stimulated (producing) reservoir volume or SRV.

Another embodiment may include a method of hydraulic fracturing a geological formation in Earth crust, including: injecting fracing fluid through a wellbore into the geological formation; measuring pressure associated with the hydraulic fracturing; determining net stress of the geological formation associated with the hydraulic fracturing; and determining presence of complex shear fracturing correlative with the net stress. The determining of the net stress may include determining real-time net stress of fractures or fracture tips. The method may include pulsing the net stress at fracture tips (including at specified times), wherein determining net stress includes calculating, via a neural network or empirical equations, net stress correlative with the pressure and other parameters of the hydraulic fracturing, wherein determining net stress and determining presence of complex shear fracturing may include determining real-time net stress of fractures or the fracture tips (e.g., at various times) to determine presence of complex shear fractures and planar tensile fractures in the geological formation during or at the hydraulic fracturing, or to determine presence of complex shear fracturing and planar tensile fracturing associated with the hydraulic fracturing. The method may include adjusting an operating parameter of the hydraulic fracturing in real time to increase or favor complex shear fracturing over planar tensile fracturing. The operating parameter may include flow rate of the fracing fluid, viscosity of the fracing fluid, or a property of a proppant in the fracing fluid, or any combinations thereof, wherein adjusting the flow rate may include adjusting speed of a pump that is pumping the fracing fluid into the geological formation, and wherein determining net stress comprises determining real-time net stress of fractures or fracture tips (e.g., at specific times or over specific time periods). The adjusting of the operating parameter of the hydraulic fracturing may be to increase complex shear fracturing by causing constructive pressure and stress pulses at different time frequencies.

The fracing fluid may be water or slick water, and include an additive affecting viscosity of the water, and other additives. The method may include adding a proppant to the fracing fluid and injecting the proppant with the fracing fluid through the wellbore into the geological formation. The determining of the net stress may include calculating, via a neural network, net stress correlative with the pressure and other parameters of the hydraulic fracturing. The other parameters may include flow rate of the fracing fluid, a size or other property of the proppant, a concentration or density of the proppant in the fracing fluid, injection rate of the proppant, or a property of the geological formation at a point of fracturing, or any combinations thereof. Lastly, the method may include determining a volume or mass of proppant (e.g., sand) in the complex shear fracturing or complex shear fractures, and determining (e.g., estimating, calculating, etc.) SRV associated with the wellbore correlative with the volume or mass of sand.

Yet another embodiment may be a hydraulic fracturing system including a pump to inject fracing fluid through a wellbore into a geological formation for hydraulic fracturing of the geological formation. The system includes a pressure sensor to measure pressure associated with the hydraulic fracturing. The pressure sensor(s) may be disposed at a wellhead of the wellbore or downhole in the wellbore, or both, wherein the pressure may be the wellhead pressure or downhole pressure, or both. The hydraulic fracturing system includes a computing system to determine net stress of the geological formation associated with the hydraulic fracturing and to determine presence of complex shear fractures caused by the hydraulic fracturing and correlative with the net stress. The computing system may include a processor and memory storing code executable by the processor to determine the net stress and the presence of complex shear fractures, and wherein the code to determine net stress may include empirical equations or a neural network, or both. The system may include a controller to adjust an operating parameter of the hydraulic fracturing system in response to the net stress to favor complex shear fracturing over planar tensile fracturing. In some examples, the computer includes the controller, or the controller includes the computer.

The system may include a feeder to discharge a proppant into a conduit conveying the fracing fluid, wherein to determine the net stress comprises calculating, via a neural network, net stress correlative with the pressure and other parameters of the hydraulic fracturing, wherein the parameters include injection rate of the fracing fluid, injection rate of the proppant, a property of the proppant, or a property of the geological formation at a point of fracturing, or any combinations thereof. The feeder may include multiple feeders to discharge the proppant into the conduit to pulse stress at fracture tips at specified times in the hydraulic fracturing, and wherein to determine presence of complex shear fractures may include to count a number of complex shear fractures. To determine presence of complex shear fractures correlative with the net stress may include determining that a number of stress events per time exceeds a threshold, and wherein a stress event comprises the net stress changing between increasing and decreasing.

Yet another embodiment includes a non-transitory, computer-readable medium having instructions executable by a processor of a computing device to: receive measured pressure data associated with hydraulic fracturing of a geological formation in the Earth crust; determine net stress of the geological formation due to hydraulic fracturing; and determine presence of complex shear fracturing or planar tensile fracturing, or both, correlative with the net stress. The non-transitory, computer-readable medium may include instructions executable by the processor to specify a set point of an operating parameter of a hydraulic fracturing system performing the hydraulic fracturing to favor complex shear fracturing over planar tensile fracturing, wherein to determine presence may include to count complex-shear fracture events and planar-tensile fracture events. To determine net stress may include calculating, via a neural network or empirical equations, net stress correlative with the measured pressure data and other parameters of the hydraulic fracturing, wherein the other parameters may include injection rate of fracing fluid, a concentration of a proppant in the fracing fluid, or size of the proppant, or any combinations thereof, and wherein the instructions may include the neural network or empirical equations, or both. To determine presence of complex shear fracturing correlative with the net stress may include comparing a number of stress events per time to a threshold, wherein the stress events are at least the net stress changing from increasing to decreasing and from decreasing to increasing, and wherein the number of stress events exceeding the threshold indicates the presence of complex shear fracturing.

A number of implementations have been described. Nevertheless, it will be understood that various modifications may be made without departing from the spirit and scope of the disclosure.

What is claimed is:

1. A method of hydraulic fracturing a geological formation in Earth crust, comprising:

injecting fracing fluid through a wellbore into the geological formation;

measuring pressure associated with the hydraulic fracturing;

determining net stress of the geological formation associated with the hydraulic fracturing;

determining presence of complex shear fracturing correlative with the net stress; and adjusting an operating parameter of the hydraulic fracturing to increase complex shear fracturing.

2. The method of claim 1, comprising adjusting the operating parameter of the hydraulic fracturing in response to the net stress, wherein the pressure comprises wellhead pressure or downhole pressure, or both, and wherein the fracing fluid comprises water.

3. The method of claim 1, comprising adjusting the operating parameter of the hydraulic fracturing in real time to favor complex shear fracturing over planar tensile fracturing, wherein the net stress comprises fracture tip stress.

4. The method of claim 1 wherein the operating parameter comprises flow rate of the fracing fluid, viscosity of the fracing fluid, or a property of a proppant in the fracing fluid, or any combinations thereof, wherein adjusting the flow rate comprises adjusting speed of a pump that is pumping the fracing fluid into the geological formation.

5. The method of claim 1, wherein measuring pressure comprises measuring pressure at a wellhead of the wellbore, wherein the geological formation comprises shale, wherein injecting fracing fluid comprises pumping fracing fluid from an Earth surface, and wherein the fracing fluid comprises slick water.

6. A method of hydraulic fracturing a geological formation in Earth crust, comprising:

injecting fracing fluid through a wellbore into the geological formation;

measuring pressure associated with the hydraulic fracturing;

determining net stress of the geological formation associated with the hydraulic fracturing; and determining presence of complex shear fracturing correlative with the net stress, wherein determining net stress comprises calculating, via a neural network, net stress correlative with the pressure and other parameters of the hydraulic fracturing.

7. The method of claim 6, comprising adding a proppant to the fracing fluid and injecting the proppant with the fracing fluid through the wellbore into the geological formation, wherein the other parameters comprise flow rate of the fracing fluid, concentration or density of the proppant in the fracing fluid, injection rate of the proppant, a property of the proppant, or a property of the geological formation at a point of fracturing, or any combinations thereof.

8. A method of hydraulic fracturing a geological formation in Earth crust, comprising:

injecting fracing fluid through a wellbore into the geological formation;

measuring pressure associated with the hydraulic fracturing;

determining net stress of the geological formation associated with the hydraulic fracturing;

determining presence of complex shear fracturing correlative with the net stress, wherein determining presence of complex shear fracturing correlative with the net stress comprises determining a number of stress events per time and comparing the number to a threshold.

9. The method of claim 8, wherein the stress events comprise the net stress changing from increasing to decreasing, wherein the stress events comprise the net stress changing from decreasing to increasing, and wherein the number of stress events exceeding the threshold indicates the presence of complex shear fracturing.

10. A hydraulic fracturing system comprising:

a pump to inject fracing fluid through a wellbore into a geological formation for hydraulic fracturing of the geological formation;

a pressure sensor to measure pressure associated with the hydraulic fracturing; and a computing system to determine net stress of the geological formation associated with the hydraulic fracturing and to determine presence of complex shear fractures caused by the hydraulic fracturing and correlative with the net stress, wherein to determine presence of complex shear fractures correlative with the net stress comprises determining that a number of stress events per time exceeds a threshold, and wherein a stress event comprises the net stress changing between increasing and decreasing.

11. The system of claim 10, wherein the pressure sensor is disposed at a wellhead of the wellbore or downhole in the wellbore, wherein the pressure comprises wellhead pressure or downhole pressure, wherein the computing system comprises a processor and memory storing code executable by the processor to determine the net stress and the presence of complex shear fractures, and wherein the code comprises empirical equations.

12. A hydraulic fracturing system comprising:

a pump to inject fracing fluid through a wellbore into a geological formation for hydraulic fracturing of the geological formation;

a pressure sensor to measure pressure associated with the hydraulic fracturing;

a computing system to determine net stress of the geological formation associated with the hydraulic fracturing and to determine presence of complex shear fractures caused by the hydraulic fracturing and correlative with the net stress; and a controller to adjust an operating parameter of the hydraulic fracturing system in response to the net stress to favor complex shear fracturing over planar tensile fracturing.

13. A hydraulic fracturing system comprising:

a pump to inject fracing fluid through a wellbore into a geological formation for hydraulic fracturing of the geological formation;

a pressure sensor to measure pressure associated with the hydraulic fracturing; and a computing system to determine net stress of the geological formation associated with the hydraulic fracturing and to determine presence of complex shear fractures caused by the hydraulic fracturing and correlative with the net stress, wherein to determine the net stress comprises calculating, via a neural network, net stress correlative with the pressure and other parameters of the hydraulic fracturing.

14. The system of claim 13, comprising a feeder to discharge a proppant into a conduit conveying the fracing fluid, wherein the other parameters comprise injection rate of the fracing fluid, injection rate of the proppant, a property of the proppant, or a property of the geological formation at a point of fracturing, or any combinations thereof.

15. A non-transitory, computer-readable medium comprising instructions executable by a processor of a computing device to:

receive measured pressure data associated with hydraulic fracturing of a geological formation in Earth crust;

determine net stress of the geological formation due to hydraulic fracturing;

determine presence of complex shear fracturing correlative with the net stress; and specify a set point of an operating parameter of a hydraulic fracturing system performing the hydraulic fracturing to favor complex shear fracturing over planar tensile fracturing, wherein the instructions comprise empirical equations to determine net stress.

16. A non-transitory, computer-readable medium comprising instructions executable by a processor of a computing device to:

receive measured pressure data associated with hydraulic fracturing of a geological formation in Earth crust;

determine net stress of the geological formation due to hydraulic fracturing; and determine presence of complex shear fracturing correlative with the net stress, wherein to determine net stress comprises calculating, via a neural network, net stress correlative with the measured pressure data and other parameters of the hydraulic fracturing, and wherein the other parameters comprise injection rate of fracing fluid, a concentration of a proppant in the fracing fluid, or size of the proppant, or any combinations thereof.

17. A non-transitory, computer-readable medium comprising instructions executable by a processor of a computing device to:

receive measured pressure data associated with hydraulic fracturing of a geological formation in Earth crust;

determine net stress of the geological formation due to hydraulic fracturing; and determine presence of complex shear fracturing correlative with the net stress, wherein to determine presence of complex shear fracturing correlative with the net stress comprises comparing a number of stress events per time to a threshold, wherein the stress events comprise the net stress changing from increasing to decreasing and from decreasing to increasing, and wherein the number of stress events exceeding the threshold indicates the presence of complex shear fracturing.

* * * * *